US005382220A

United States Patent [19]

Romanauskas et al.

[11] Patent Number: 5,382,220

[45] Date of Patent: Jan. 17, 1995

[54] CENTRIFUGE TUBE ADAPTER

[75] Inventors: William A. Romanauskas; Edward T. Sheeran, Jr., both of Southbury, Conn.

[73] Assignee: E. I. Du Pont de Nemours and Company, Wilmington, Del.

[21] Appl. No.: 229,844

[22] Filed: Apr. 12, 1994

Related U.S. Application Data

[63] Continuation of Ser. No. 35,513, Mar. 22, 1993, abandoned, which is a continuation of Ser. No. 695,871, May 6, 1991, abandoned, which is a continuation-in-part of Ser. No. 552,631, Jul. 13, 1990, abandoned, which is a continuation-in-part of Ser. No. 432,646, Nov. 7, 1989, abandoned.

[51] Int. Cl.[6] ..... B04B 5/02

[52] U.S. Cl. ..... 494/85; 494/16

[58] Field of Search ..... 494/16–20, 494/45, 85; 215/228, 277; 422/72

[56] References Cited

U.S. PATENT DOCUMENTS

| | | | |
|---|---|---|---|
| 3,027,799 | 4/1962 | Weichselbaum | 88/14 |
| 3,159,298 | 12/1964 | Saw | 215/43 |
| 3,635,370 | 1/1972 | Romanauskas | 220/46 R |
| 3,674,197 | 7/1972 | Mitchell et al. | 233/14 R |
| 3,720,502 | 3/1973 | Gropper et al. | 23/292 |
| 3,918,920 | 11/1975 | Barber | 23/292 |
| 3,938,735 | 2/1976 | Wright et al. | 233/26 |
| 3,998,383 | 12/1976 | Romanauskas et al. | 233/26 |
| 4,015,775 | 4/1977 | Rohde | 233/26 |
| 4,030,663 | 6/1977 | Conn et al. | 233/26 |
| 4,032,066 | 6/1977 | Wright | 233/26 |
| 4,076,170 | 2/1978 | Chulay et al. | 233/26 |
| 4,080,175 | 3/1978 | Chulay et al. | 23/292 |
| 4,087,043 | 5/1978 | Anderson et al. | 233/26 |
| 4,114,803 | 9/1978 | Romanauskas | 233/26 |
| 4,166,573 | 9/1979 | Webster | 233/26 |
| 4,190,196 | 2/1980 | Larsen | 233/26 |
| 4,222,513 | 9/1980 | Webster et al. | 233/26 |
| 4,235,367 | 11/1980 | Davidson | 233/26 |
| 4,285,904 | 8/1981 | Ishimaru et al. | 264/322 |
| 4,290,550 | 9/1981 | Chulay et al. | 233/26 |
| 4,301,963 | 11/1981 | Nielsen | 233/26 |
| 4,304,356 | 12/1981 | Chulay et al. | 233/26 |
| 4,306,676 | 12/1981 | Edwards et al. | 233/26 |
| 4,360,150 | 11/1982 | Ishimaru et al. | 233/26 |
| 4,451,250 | 5/1984 | Romanauskas | 494/85 |
| 4,533,955 | 11/1985 | Lam et al. | 494/16 |
| 4,537,320 | 8/1985 | Nielsen | 215/270 |
| 4,552,278 | 11/1985 | Romanauskas | 215/277 |
| 4,690,670 | 9/1987 | Nielsen | 494/16 |
| 4,692,137 | 9/1987 | Anthony | 494/85 |
| 4,832,678 | 5/1989 | Sheeran | 494/20 |
| 4,944,721 | 7/1990 | Carson | 494/16 |
| 4,974,460 | 12/1990 | Baxter | 73/864 |
| 5,158,749 | 10/1992 | Eberle | 422/102 |

OTHER PUBLICATIONS

Nalgene Ultra-Lok Tube System, Nalgene Produce News, vol. 8, No. 1, 1989. (3 pages).

Handbook of Plastics and Elastomers, McGraw-Hill Book Company, 1975, (Harper, Editor) p. 12-9.

Sorvall Type KSB "Szent-Gyorgyi & Blum" 8 Tube Continuous Flow System Diagram & Price List, effective Oct. 1, 1969.

*Primary Examiner*—Robert W. Jenkins

[57] ABSTRACT

An adapter for a centrifuge tube comprises two segments that may be hinged along a hinge axis that extends perpendicular to the axis of the adapter.

44 Claims, 13 Drawing Sheets

CENTRIFUGE TUBE ADAPTER

CROSS REFERENCE TO RELATED APPLICATION

This is a continuation of U.S. application Ser. No. 08/035,513 filed Mar. 22, 1993, now abandoned, itself a continuation of U.S. Ser. No. 07/695,871 filed May 6, 1991, now abandoned, itself a continuation-in-part of U.S. application Ser. No. 07/552,631, filed Jul. 13, 1990, now abandoned, itself a continuation-in-part of U.S. Ser. No. 432,646, filed Nov. 7, 1989, now abandoned.

BACKGROUND OF THE INVENTION

1. Field of the Invention

The present invention relates to an adapter for holding a centrifuge tube in a centrifuge rotor cavity, and in particular, to an adapter having two segments, the segments being in some cases joined by a hinge, the hinge axis extending perpendicular to the axis of the adapter.

2. Description of the Prior Art

In the operation of a centrifuge it is important that the size and shape of the tube in which a liquid sample is carried closely conforms to the size and shape of the cavity in the centrifuge rotor in which the tube is received. During centrifugation the centrifugal force exerted on the tube itself and the liquid therein acts to deform the centrifuge tube. A centrifuge tube which does not closely conform to the rotor cavity may thus be deformed to the point of rupture. Even if the tube does not rupture the deformation may make the tube difficult to remove from the rotor cavity. Moreover, even if the deformed tube is removable from the rotor, the return of the tube to its undeformed shape may agitate the contents of the tube to an extent that destroys the sample separation.

When the shape and size of a centrifuge tube does not closely conform to the shape and size of the rotor cavity in which it is to be disposed a device known as a tube adapter is usually employed. The tube adapter has an interior cavity having a shape and size which closely conforms to the shape and size of the centrifuge tube being adapted. The exterior shape and size of the adapter closely conforms to the shape and size of the rotor cavity in which the tube is to be used. The adapter serves to support a tube within the cavity in which it is received and thus serves to prevent deformation of the tube during centrifugation.

Exemplary of an adapter formed of a single unitary member is the device disclosed in U.S. Pat. No. 4,304,356 (Chulay et al.). This adapter supports only the neck region of the centrifuge tube and is fabricated of a material having a lower density than the liquid being carried therein to prevent bottoming of the adapter in the rotor cavity in the event of tube rupture.

Exemplary of an adapter formed of two piece construction is the device shown in U.S. Pat. No. 3,674,197 (Mitchell et al.), assigned to the assignee hereof. This adapter comprises two discrete segments, each of which has an indentation therein. When joined the indentations form a recess for receiving a collapsible bag during centrifugation. The adapter disclosed in this patent includes aperture(s) through which tubes from the bag exit the adapter. Thus, the possibility exists that the bag may extrude through these apertures if the adapter were to undergo centrifugation in a vertical angle rotor.

An adapter arrangement formed of two discrete adapter segments and useful to support the capped end of a centrifuge tube is available as part of the Nalgene Ultra-Lok Tube System sold by Fisher Scientific Incorporated.

U.S. Pat. No. 4,692,137 (Anthony) discloses a tube adapter having two segments which are hinged along the lateral edges of the segments. The hinge axes align in parallel relationship to the axis of the cavity in which the adapter is received. The disposition of hinges along the lateral edges of the segments is believed disadvantageous in that such a disposition may interfere with the insertion or removal of the adapter into or from the rotor cavity.

U.S. Pat. No. 3,998,383 (Romanauskas et al.) and U.S. Pat. No. 4,015,775 (Rohde), both assigned to the assignee of the present invention, disclose centrifuge rotors of the vertical angle type. In such a rotor the axis of the rotor cavities is substantially parallel to the axis of rotation. When using a vertical angle rotor it is necessary that a cap be provided at the mouth of each cavity to impose a vertical restraining force on the tube disposed in the cavity. Even though the tube may be disposed in an adapter received within the cavity, without such a capping arrangement the possibility exists that the pressure of the liquid during centrifugation may rupture the tube. U.S. Pat. No. 3,998,383 (Romanauskas et al.) exemplifies a typical capping arrangement for a vertical angle rotor.

Such capping arrangements must be individually threaded into the rotor body. Moreover, in order to provide proper support it is necessary that the capping arrangement be in intimate contact with the tube. Improper assembly can thus lead to the possibility of tube rupture and/or cap failure. For these reasons such capping arrangements are believed disadvantageous.

In view of the foregoing it is believed advantageous to provide an adapter for use in a vertical angle rotor that eliminates the necessity of a capping mechanism for the rotor cavity.

SUMMARY OF THE INVENTION

The present invention relates to an adapter having an axis therethrough for supporting a centrifuge tube within a cavity in a centrifuge rotor. The cavity itself has an axis therethrough. The axis of the adapter may, in use, align in parallel relationship with the axis of the cavity. The adapter comprises a first and a second adapter segment, each segment having an exterior surface and a mating surface thereon. Each segment has an indentation in the mating surface thereof. The segments may be connected by at least one hinge that supports the segments for relative pivotal movement about a hinge axis from an open to a mated position. The hinge axis extends perpendicular to the axis of the adapter.

When in the mated position the mating surfaces of the segments are in contacting relationship and the indentations therein cooperate to define a recess having a predetermined shape. In one embodiment of the adapter of the present invention, used with a centrifuge tube having a body with a neck thereon in which a portion of the neck has a constricted region when the tube is capped, the indentation in each segment is shaped such that when the segments are in the mated position the recess is sized to closely correspond to the configuration of at least the neck of the tube. In this embodiment at least one of the segments has a feature on the mating surface thereof that projects into the indentation therein. When the segments are in the mated position and the neck of the tube is received within the adapter the feature is received within the constricted region of the neck of the tube. A collar may be provided to prevent the bottoming of the tube in the cavity.

In another embodiment of the adapter of the present invention the indentation in each segment is shaped such that when the segments are in the mated position the recess so defined is sized to closely correspond to the size and configuration of the centrifuge tube over its entire length.

In another aspect the present invention relates to an adapter for supporting a closed centrifuge tube having a predetermined size and configuration within a cavity in a vertical angle centrifuge rotor. The rotor is rotatable to a predetermined maximum speed. The adapter has a central axis extending therethrough that, in use, aligns in parallel relationship both with the axis of the rotor cavity in which the adapter is disposed and with the axis of rotation of the vertical angle rotor. The adapter comprises a first and a second adapter segment, each of which has an exterior surface and a mating surface thereon. Each segment has an indentation in the mating surface thereof. The indentations are shaped such that when the segments are joined along their mating surfaces the indentations cooperate to define a recess able to totally surround a centrifuge tube disposed therein. Each adapter segment is fabricated of a material that has sufficient strength to withstand the vertical forces created by the pressure of a liquid under centrifugation. Thus, use of an adapter in accordance with this aspect of the present invention permits a tube to be centrifuged in a vertical angle centrifuge rotor without the necessity of a capping mechanism being placed in the rotor cavity.

In still another aspect the mating surface on each adapter segment defines a predetermined angle with respect to a plane that is normal to a plane containing the line of action along which the adapter segments are joined. Inclination of the mating surfaces of the adapter segments allows the same to displace relative to each other to totally fill the rotor cavity in which they are disposed without any separation being defined between the segments. Inclined mating surfaces may be provided on any of the adapter segments disclosed in the present application.

In still another aspect the present invention relates to an adapter for supporting a closed centrifuge tube in which at least one of the adapter segments has an effective weight sufficient to balance forces created by the pressure of a liquid carried in the tube under centrifugation that act transversely to the central axis. In use, with the adapter inserted into a cavity of a rotor, the one segment is disposed closer to the axis of rotation so that the mating surfaces of the adapter segments lie in a plane that is perpendicular to a radius of the rotor extending through the cavity. In such a disposition the weight of the one segment while under centrifugation is sufficient to maintain the mating surfaces of the adapter segments in contacting relationship with each other. Suitable keying may be provided to identify the one segment having the predetermined effective weight.

BRIEF DESCRIPTION OF THE DRAWINGS

The invention will be more fully understood from the following detailed description thereof, taken in connection with the accompanying drawings, which form a part of this application and in which:

FIG. 7A is a perspective view of an adapter in accordance with another aspect of the present invention used to support a closed tube within the cavity of a vertical angle rotor, the adapter segments being independent of each other, while

FIG. 11A is a side sectional view of an adapter of FIG. 10 in use and supporting a centrifuge tube over its entire axial length in a vertical angle centrifuge rotor cavity, while FIG. 12A is a perspective view of a modification of the embodiment of the adapter shown in FIGS. 10 and 11 with the inboard adapter segment having a keying configuration thereon, while

DETAILED DESCRIPTION OF THE INVENTION

Figure 2:
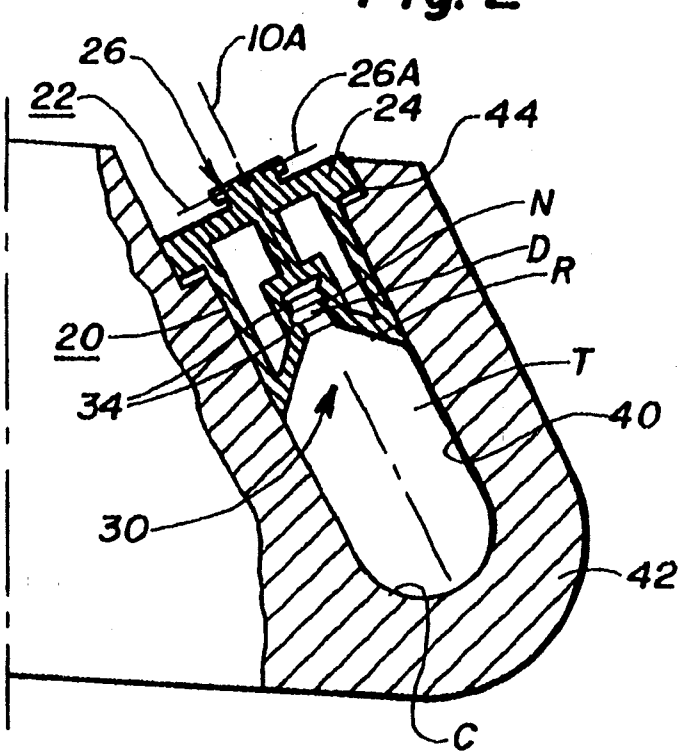
FIG. 2 is a fragmentary elevation view, in section, of the tube adapter of FIG. 1 in use and supporting the neck portion of a centrifuge tube in a fixed angle rotor cavity.

Throughout the following detailed description, similar reference numerals refer to similar elements in all Figures of the drawings. Superscripted numerals generally relate to corresponding functional elements or features throughout all of the Figures of the drawings.

Figure 1:
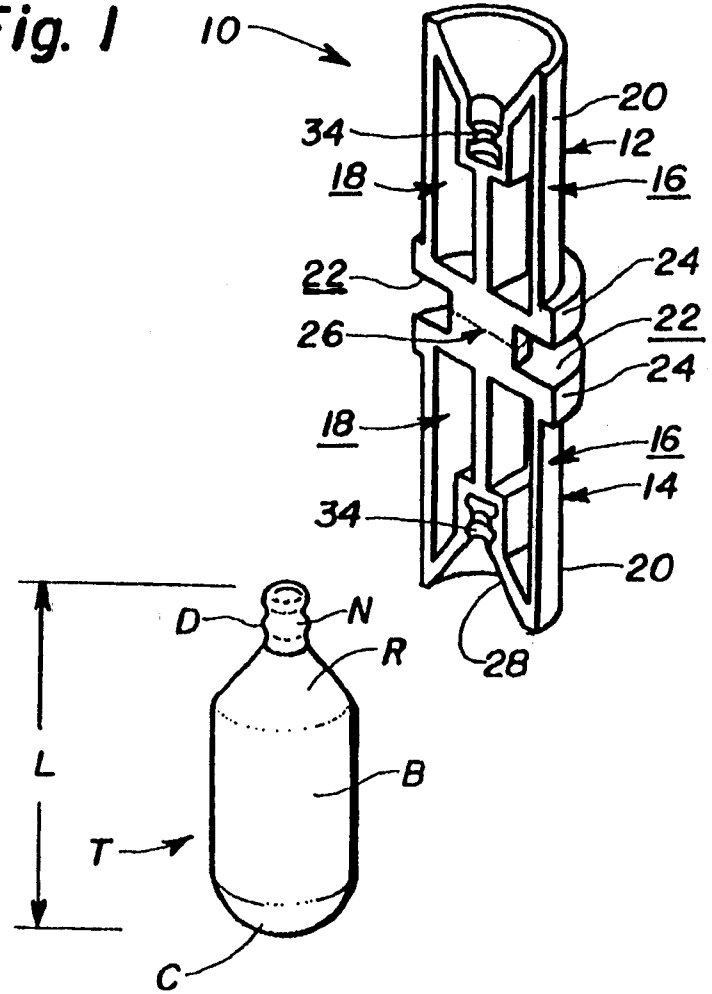
FIG. 1 is a perspective view of an adapter according to a first embodiment of the present invention for supporting the neck region of a centrifuge tube of the type in which a portion of the tube neck has a constricted region thereon when capped, the adapter being shown in the open position.

FIG. 1 is an exploded perspective view of an adapter, generally indicated by the reference character 10, according to a first embodiment of the present invention. The adapter 10 in accordance with this embodiment is useful for supporting a centrifuge tube T of the type having a body portion B with a closed end C, the body B tapering through a transition region R to a narrowed neck region N. The neck N serves as the liquid port through which a liquid under test may be loaded into the tube T. When the tube T is capped at least one portion D of the neck N becomes radially inwardly constricted, thereby forming a constricted :region in the neck of the tube. Preferably the capping assembly disclosed in U.S. Pat. No. 4,552,278 (Romanauskas) is used to cap the tube, so that the neck N of the tube has a corrugated configuration imparted thereto. The corrugated configuration has at least one and optionally a plurality of circumferentially extending corrugations formed in the neck N. It should be understood that any other capping arrangement may be used, so long as any form of constricted region is imparted to the configuration of the neck N.

The adapter 10 is comprised of a first adapter segment 12 and an identical second adapter segment 14. Each segment 12, 14 has an exterior surface 16 and a planar mating surface 18 thereon. The exterior surface 16 of each segment is defined by a generally cylindrical lateral surface portion 20 and a planar upper surface portion 22. In the preferred instance an enlarged collar 24 is disposed intermediate the lateral surface portion 20 and the upper surface portion 22. When the segments 12, 14 are mated together the mating surfaces 18 thereof are joined in abutting contact. As will become clearer herein the member so produced has an axis 10A (best seen in FIG. 2) extending therethrough. As is best seen in FIG. 2 the configuration and size of the adjacent lateral surface portions 20 closely corresponds to the configuration and diameter of a rotor cavity 40 in which the adapter 10 is used. The upper surface portions 22 of the conjoined segments are accessible when the adapter 10 is received in the rotor cavity 40.

The segments 12 and 14 are connected and supported for relative pivotal movement with respect to each other by at least one hinge 26. The hinge 26 may take the form of a live hinge bridging the upper surface portions 22 of the segments 12, 14, or may, if desired, take the form of a coined hinge. The term "live hinge" refers to a hinge type, typically made of a polypropylene material, which must be flexed or bent before the plastic is cooled or permanently set. Such hinges are complete without secondary operations. The term "coined hinge" refers to a hinge that is cold-formed, usually by a stamping operation. The stamping operation creates a narrower and a thinner flexing region which defines a hinge. These forms of hinges are defined in the Handbook of Plastics and Elastomers, McGraw-Hill Book Company 1975, (Charles A. Harper, Editor) at page 12–9.

However formed, in accordance with the present invention the axis 26A of the hinge 26, that is, the axis about which occurs the relative pivotal motion of the segments, extends perpendicular to the axis 10A of the adapter 10. This relationship of the hinge axis 26A to the axis 10A of the adapter 10 is best illustrated in FIG. 2.

The mating surface 18 of each of the adapter segments 12, 14 has an indentation 28 therein. The indentation 28 in each segment 12, 14 corresponds to the size and contour of at least a portion of the tube T. Thus, when the segments 12, 14 are mated, the indentations 28 therein cooperate to define a recess 30 (FIG. 2) that corresponds to the size and shape of at least a predetermined portion of the tube T that is received therein.

In the embodiment of FIG. 1, in which the adapter 10 is configured and sized to support only the neck N and the transition region R of the tube T, at least one but preferably both indentations 28 contains a feature 34, in the form of a circumferentially extending ridge, that corresponds in size and is located complementarily to the position of the constriction D in the neck N of the tube.

The adapter 10 shown in FIGS. 1 and 2 is especially useful when the diameter of body B of the tube T is equal to the diameter of a cavity 40 in a centrifuge rotor 42, but the overall length L of the tube T is less than the axial length or the cavity. The rotor cavity 40 has an axis 40A therethrough that aligns in parallel relationship with the axis 10A of the adapter 10 when the same is disposed therein. In use, as is best seen in connection with FIG. 2, the adapter 10 defined by the mated segments 12, 14 serves to support the neck N and the transition region R of the tube T within the cavity 40.

To mount the tube T in the cavity, the tube T is inserted into one of the segments 12, 14, so that the feature 34 on the segment(s) is received within the constricted region D in the neck N of the tube T when the segments are in the mated position. The segments 12, 14 are then pivoted about the hinge axis 26A to place the mating surfaces 18 thereon in abutting contact. This closes the adapter 10 around the tube T and thus permits the tube T to be manipulated by manipulation of the adapter 10. The tube T and the adapter 10 are then axially inserted into the cavity 40. In the preferred instance the tube T bottoms against the closed end of the cavity 40.

The axial length of the adapter 10 is selected such that when the tube T is received in the cavity 40, the upper surface portions 22 on the segments 12, 14 are accessible to a user. The hinge 26 may be formed so as to define a useful lifting appliance, as shown in FIG. 2. Thus, to withdraw the tube T at the end of a centrifugation run, a user grasps the hinge 26 and lifts the tube from the cavity 40. It should be appreciated from the foregoing that the feature 34 in such an instance defines a lifting surface which acts against the material of the tube in the constricted region D in the neck N thereof, and thus serves to transmit the lifting force to the tube T to withdraw the same from the cavity. The tube T may is withdrawn without unduly agitating the separation within the tube T.

In some cases the rotor 42 may have a shoulder 44 defined about the mouth of the cavity 40. The shoulder 44 is preferably located on the rotor 42 at a position that is axially beneath the collars 24 on the segments 12, 14 when the adapter is received within the cavity, thereby to guard against the possibility that tube rupture will permit the adapter 10 to enter into the cavity 40.

The segments 12, 14 with the hinge 26 therebetween are preferably integrally formed from a suitable material, such as polypropylene. Of course, the segments 12, 14 may be otherwise fabricated from one or more pieces, using other manufacturing techniques and other materials, and assembled to define the adapter 10. Similar techniques may be used to form any other embodiment of the adapter illustrated and discussed herein.

Figure 4:
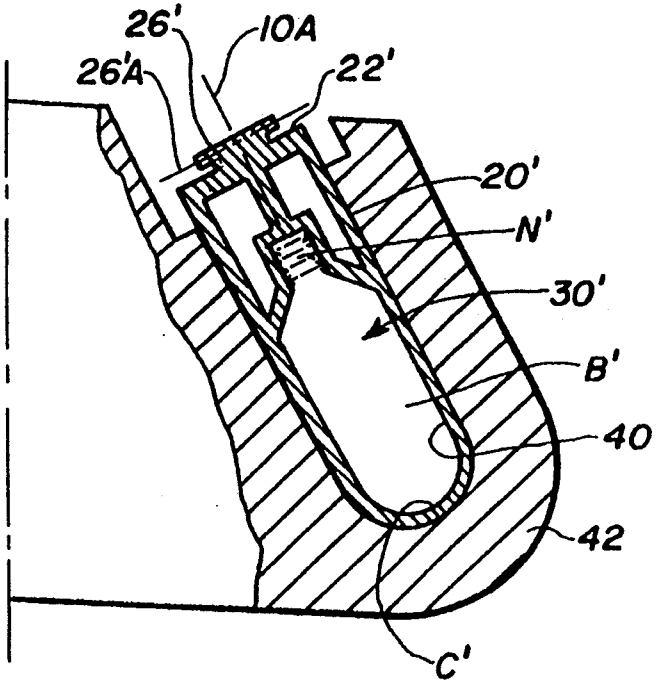
FIG. 4 is a fragmentary elevation view, in section, of the tube adapter of FIG. 3 in use and supporting a centrifuge tube over its entire axial length in a fixed angle rotor cavity.
Figure 3:
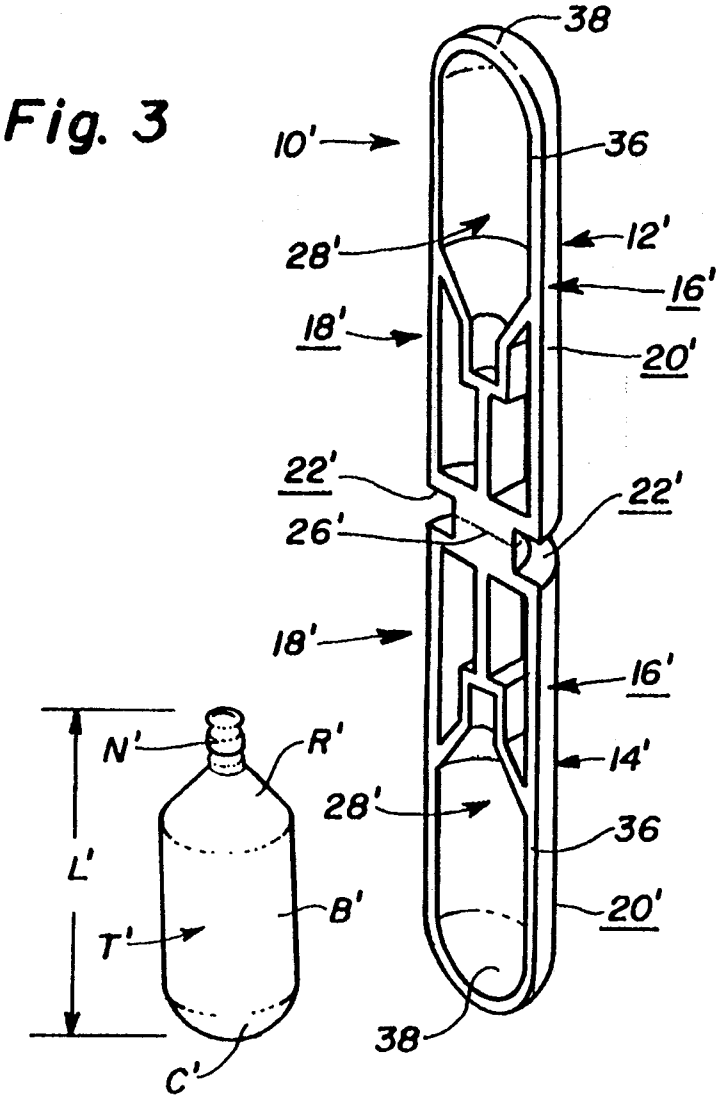
FIG. 3 a perspective view of an adapter according to a second embodiment of the present invention for supporting the full length of a centrifuge tube within a rotor cavity, the adapter being shown in the open position.
Figure 6:
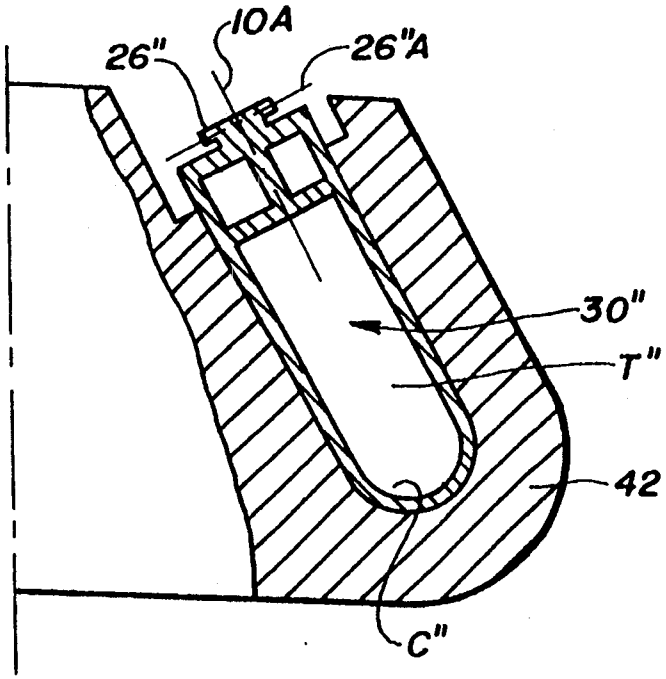
FIG. 6 is a fragmentary elevation view, in section, of the centrifuge tube adapter of FIG. 5 in use and supporting a centrifuge tube over its entire axial length in a fixed angle rotor cavity.

For those instances wherein the diameter of the tube T is less than the corresponding diameter of the cavity 40 the adapter 10' shown in FIGS. 3 and 4 finds utility. In this embodiment of the invention the recess 30' (FIG. 4) formed by the cooperative association of the indentations 28' in the mated adapter segments 12', 14' is configured to correspond to the size and shape of the tube T' over the entire axial length L' thereof. For this purpose the segments 12', 14' are each provided with an axial extension 36 having a bottom wall 38. The bottom wall 38 need not completely close the bottom of the adapter 12', 14', as is illustrated, but may only partly close the same. The presence of the extension 36 and the bottom wall 38 permit the recess 30' defined when the segments 12', 14' are joined to receive the entire axial length L' of the tube T'.

FIG. 4 illustrates this embodiment of the invention in use. When the tube T' is received in the recess 30' the closed end C' of the tube T' is contacted by the interior surface of the bottom wall 38. Preferably the indentations 28' in the segments 12', 14' are placed such that the tube T' lies as close to the bottom of the rotor cavity 40, thereby to maximize the centrifugal force imposed on the liquid sample. It should also be noted that in this embodiment of the invention the feature 34 present in the embodiment of FIG. 1 is not required, since the requisite lifting force transmission surface is defined by the bottom wall 38 operating against the bottom end C' of the tube T'. It is also noted that in this embodiment of the invention the collar 24 may be eliminated.

Figure 5:
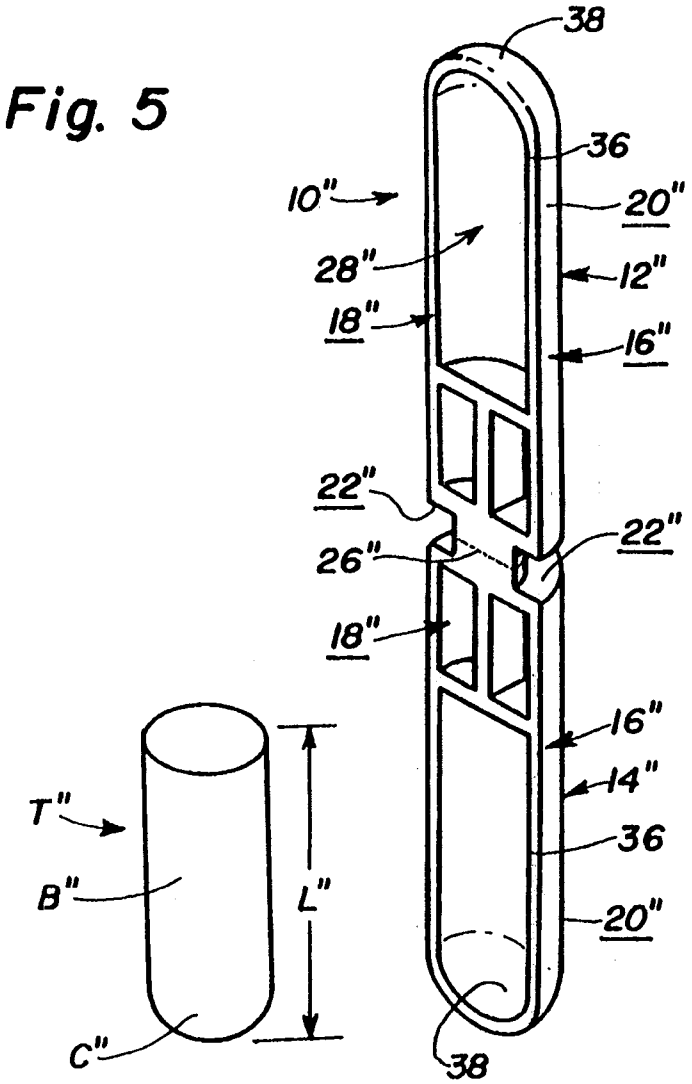
FIG. 5 is a perspective view similar to FIG. 3 of a modification of the embodiment of the tube adapter there shown for use with an open top tube.

FIG. 5 illustrates an adapter 10'' that defines a modification of the embodiment of the invention shown in FIG. 3. In this embodiment, the tube T'' has the form of a test tube, with no constriction present to define a neck. In this instance, the segments 12'', 14'' are modified to exhibit indentations 28'' similar to those shown in FIG. 3, but which correspond in size and shape to the test tube T'' over the entire axial length L'' thereof.

In whatever one of the embodiments used, the hinge between the segments is disposed on the upper surface portion of the exterior surface of the adapter segments. Such a disposition is believed advantageous in that it locates the hinge at a position where the hinge does not interfere with the receipt of the adapter within the rotor cavity. At the same time the hinge defines a useful lifting appliance.

Although the adapter previously illustrated and discussed may find utility in the environment of a vertical angle rotor, such a utilization may typically require the provision of a suitable capping arrangement to prevent tube failure. The capping arrangement is required in the case that the adapter does not completely surround the tube, such as shown in FIGS. 1 and 2. However, a capping arrangement is also required if the adapter does completely surround the tube, as shown in FIGS. 3 through 6, but does not have sufficient strength to withstand the vertical force due to liquid pressure under centrifugation.

Figure 7A:
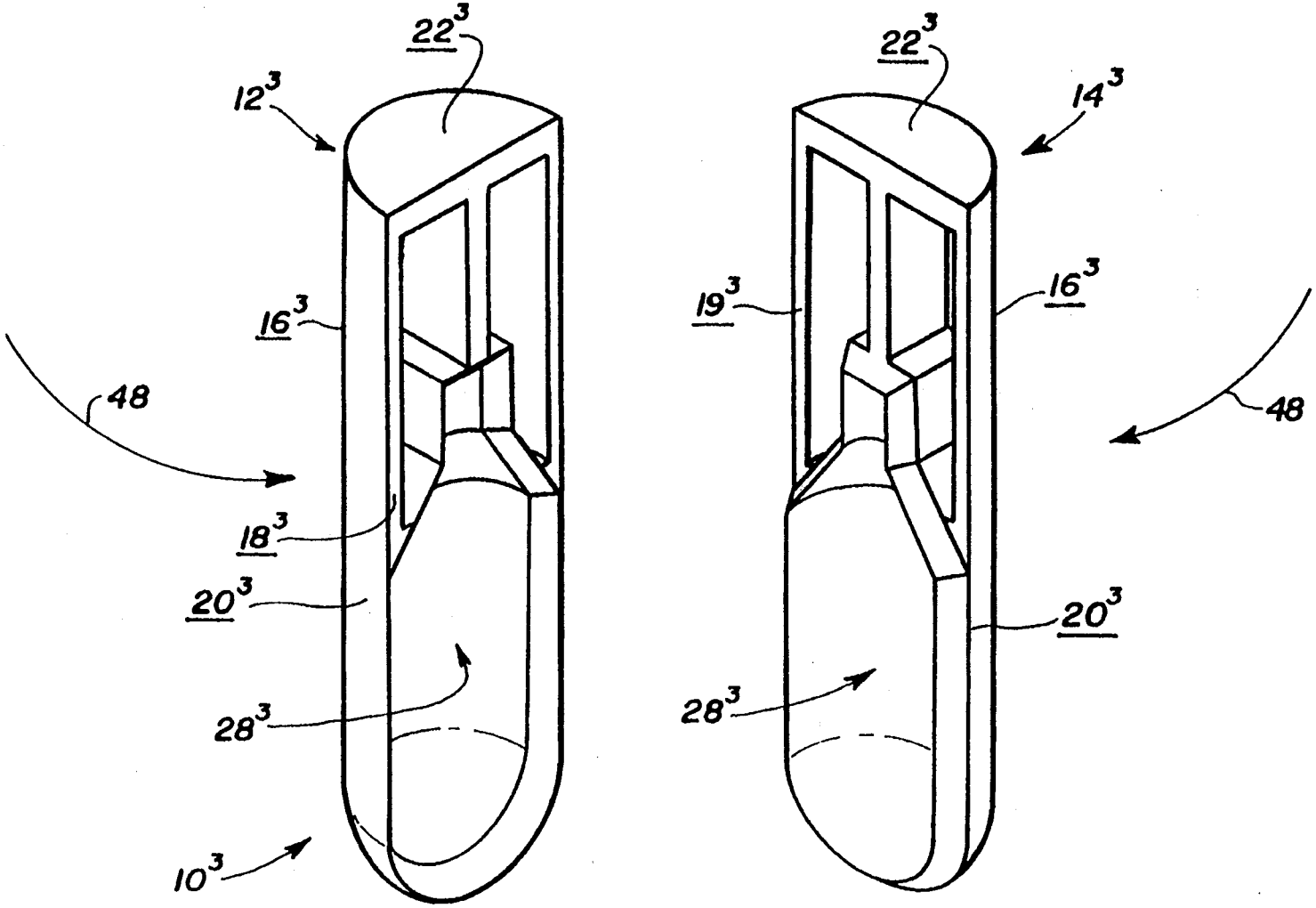
Figure 7B:
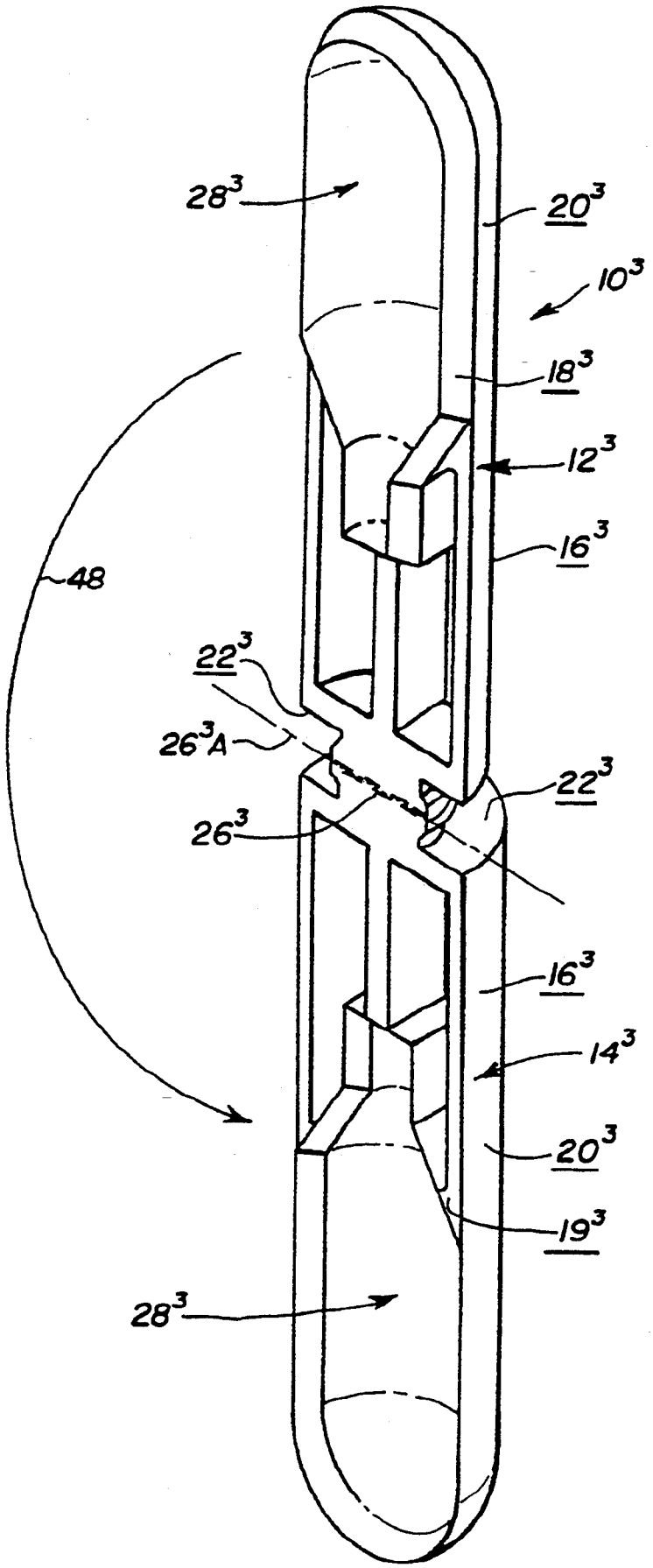
FIG. 7B is a modification of the embodiment of adapter shown in FIG. 7A in which the adapter segments are hinged.

As outlined earlier, a capping arrangement may be viewed as disadvantageous for various reasons. Accordingly, it is believed desirable to provide an adapter able to support a closed tube T in a vertical angle rotor without the necessity of a capping arrangement. FIGS. 7A and 7B illustrate such an adapter in accordance with another aspect of the present invention. FIG. 7A illustrates an unhinged embodiment of the vertical angle rotor adapter, while FIG. 7B shows a hinged embodiment thereof.

The vertical angle rotor adapter shown in FIGS. 7A and 7B is generally indicated by the reference character $10^3$ and is generally similar to the adapters 10' and 10'' discussed in connection with FIGS. 3 and 5 in the sense that the adapter $10^3$ is arranged to totally surround the tube T disposed therewithin. The adapter $10^3$ comprises a first adapter segment $12^3$ and a second adapter segment $14^3$. Each segment $12^3$, $14^3$ has an exterior surface $16^3$ thereon. The exterior surface $16^3$ of each segment $12^3$, $14^3$ is defined by a generally cylindrical lateral surface portion $20^3$ and a planar upper surface portion $22^3$.

In accordance with the embodiment of the invention shown in FIGS. 7A and 7B the adapter segment $12^3$ has a planar mating surface $18^3$ thereon while the adapter segment $14^3$ has a planar mating surface $19^3$ thereon. For a reason which is explained more fully herein the mating surfaces $18^3$ and $19^3$ on the segments $12^3$ and $14^3$, respectively, are angled with respect to a predetermined reference plane, to be defined. The inclination of the mating surfaces $18^3$ and $19^3$ on the segments $12^3$ and $14^3$, respectively, is believed best seen in FIGS. 9A and 9B. It should be understood that the mating surfaces of the adapter segments in any of the embodiments shown in FIGS. 1 through 6 may also be inclined in the manner shown in FIGS. 9A and 9B.

The mating surfaces $18^3$ and $19^3$ of each of the adapter segments $12^3$ and $14^3$, respectively, each have an indentation $28^3$ therein. The indentation $28^3$ in each segment $12^3$ and $14^3$ corresponds to the size and shape of the entire axial length L of the tube T. Thus, when the segments $12^3$ and $14^3$ are mated the indentations $28^3$ therein cooperate to define a recess $30^3$ (FIG. 8) that corresponds to the size and shape of the entire axial length of the tube T (FIGS. 1 and 8) that is received therein. That is to say, the indentations $28^3$ in each segment are shaped such that when the segments $12^3$ and $14^3$ are joined along their respective mating surfaces $18^3$ and $19^3$ the indentations $28^3$ in each segment cooperate to define a recess $30^3$ able to totally surround a centrifuge tube T disposed therein.

Figure 8:
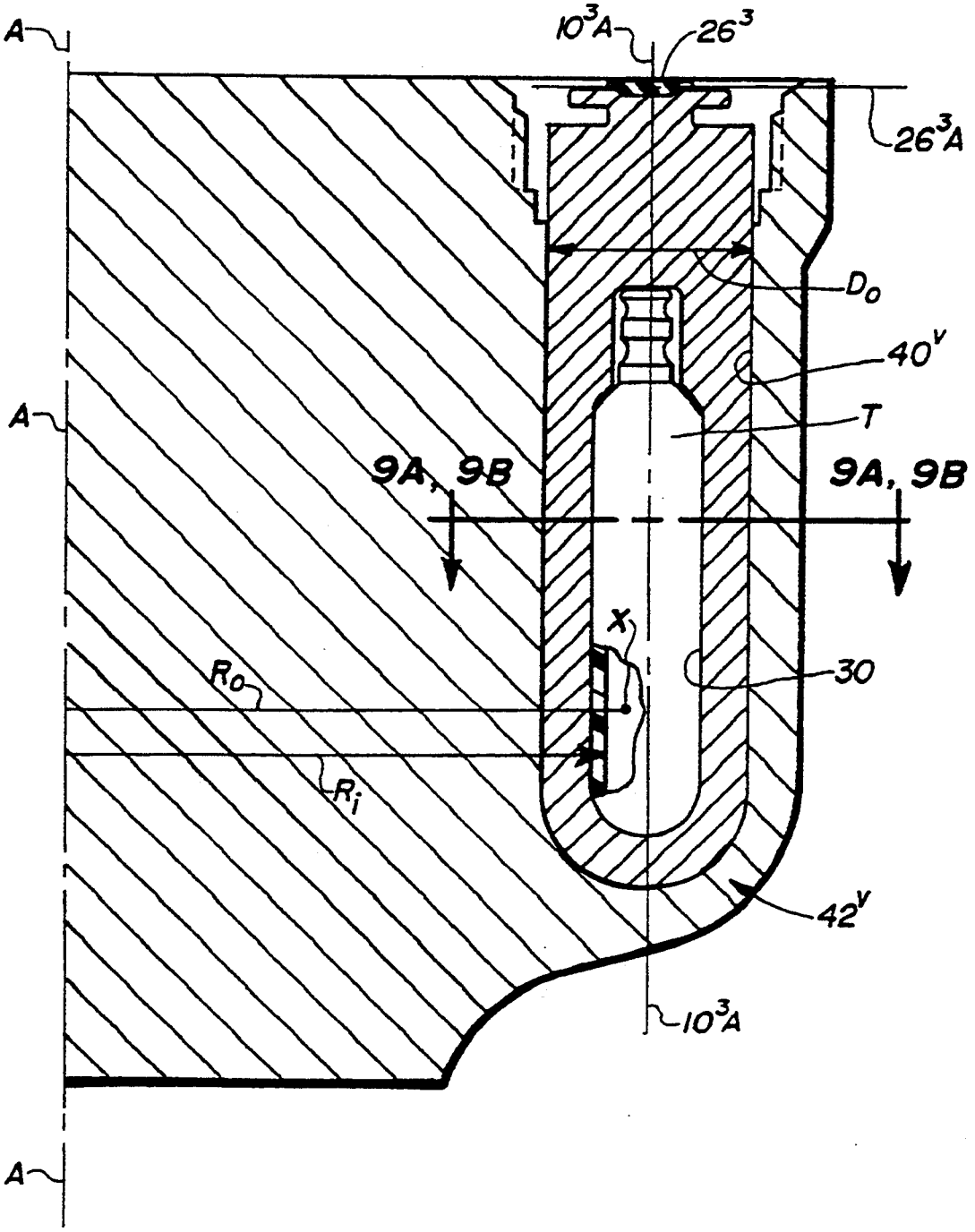
FIG. 8 is a fragmentary elevational view of an adapter shown in either FIG. 7A or 7B in use and supporting a centrifuge tube over its entire axial length in a vertical angle centrifuge rotor cavity, with a portion of the tube being broken away.

FIG. 8 illustrates the adapter $10^3$ in accordance with this aspect of the present invention in use in the environment of a vertical angle centrifuge rotor $42^V$. In such a rotor the axis of each cavity $40^V$ is parallel or approaching parallel (with an inclination angle of not more than fifteen (15) degrees) to the axis of rotation A of the rotor. As seen from FIG. 8 the adapter $10^3$ has a central axis $10^3$A that, in use, aligns with the axis of the cavity $40^V$ in which it is disposed and with the axis of rotation A of the vertical angle rotor $42^V$.

In the embodiment of the invention shown in FIG. 7A the segments $12^3$, $14^3$ are independent of each other. These segments $12^3$, $14^3$ may be joined by moving each segment toward the other along a line of action 48 thereby to bring the mating surfaces $12^3$, $14^3$ thereof in abutting contact. As used herein the term "line of action" is meant to denote that direction of motion which joins the segments $12^3$, $14^3$ such that, in a given predetermined plane perpendicular to the central axis $10^3$A simultaneous contact of both sides of the segments $12^3$, $14^3$ occurs.

In FIG. 7B the segments $12^3$, $14^3$ are connected and supported for relative pivotal movement with respect to each other by at least one hinge $26^3$. The pivotal axis $26^3$A (FIG. 8) of the hinge $26^3$, that is, the axis about which occurs the relative pivotal motion of the segments $12^3$, $14^3$, extends perpendicular to the axis $10^3$A of the adapter $10^3$. As discussed earlier the hinge $26^3$ may take the form of a live hinge bridging the upper surface portions $22^3$ of the segments $12^3$, $14^3$, or may, if desired, take the form of a coined hinge. Accordingly the segments $12^3$, $14^3$, as shown in the embodiment of FIG. 7B may also be joined by moving each segment toward the other along the line of action 48. In the embodiment of FIG. 7B it is noted that the line of action 48 also lies in the plane perpendicular to the pivotal axis $26^3$A of the hinge $26^3$.

Figure 9B:
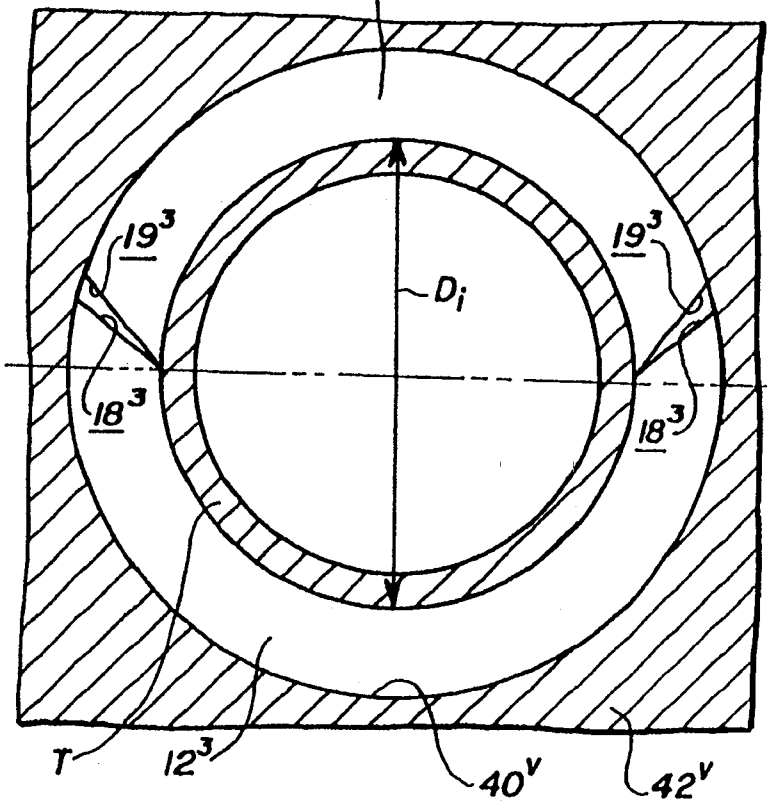
FIGS. 9A and 9B are sectional views taken along section lines 9A—9A, 9B—9B in FIG. 8 showing the inclination of the mating surfaces of the adapter segments, the view of FIG. 9A illustrating the relationship of the adapter segments with respect to each other, with respect to the tube received in the adapter, and with respect to the rotor cavity in which the adapter is placed while rotor is at rest while the view of FIG. 9B shows the relationship of the adapter segments with respect to each other, with respect to the tube received in the adapter, and with respect to the rotor cavity in which the adapter is placed when the rotor is rotating.
Figure 9A:
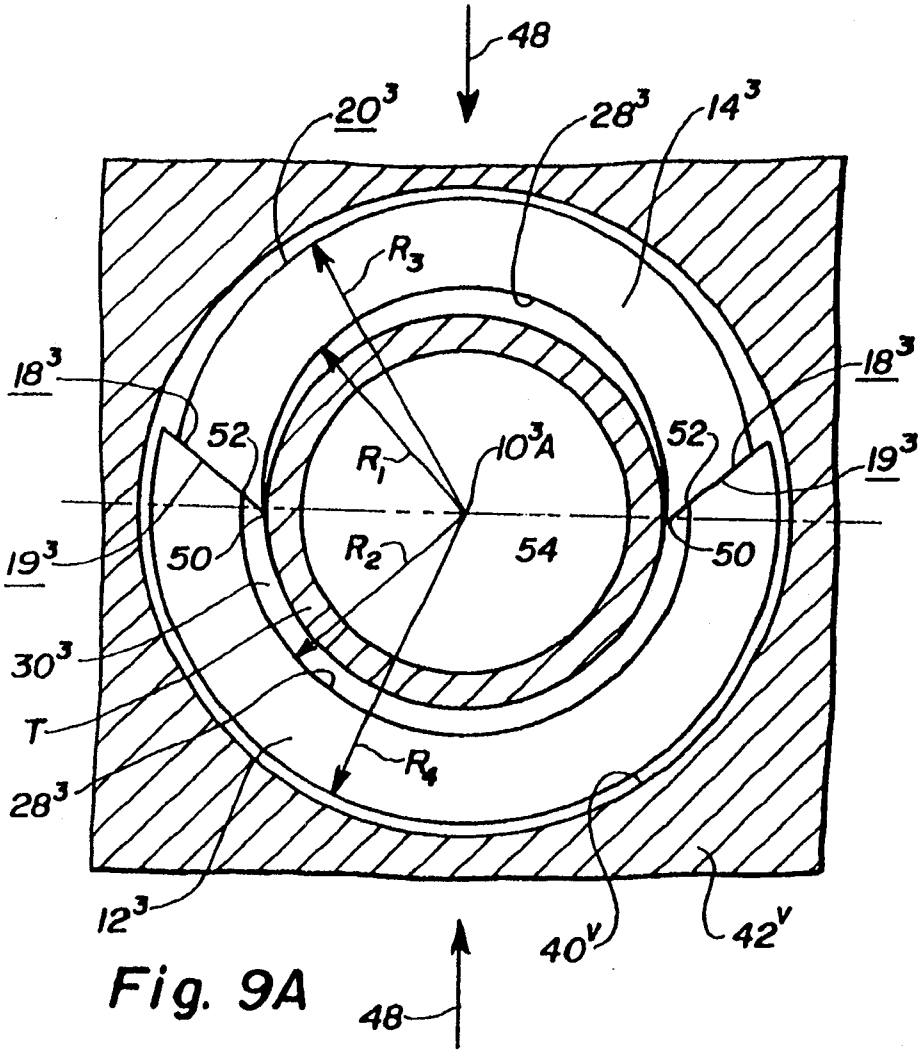

With reference to the sectional views of FIGS. 9A and 9B, the inclination of the surfaces $18^3$, $19^3$ may be most clearly seen. (Sectioning of the adapter has been omitted from FIGS. 9A and 9B for clarity of illustration). When the segments $12^3$, $14^3$ are joined, the tube T is totally surrounded by the adapter $10^3$. By inclining the mating surfaces $18^3$, $19^3$ the segments $12^3$, $14^3$ may expand during centrifugation to fill the entirety of the rotor cavity $40^V$. Thus, any variations in the size of the various cavities $40^V$ in a given rotor, variations in cavity size from rotor to rotor, and variations in the thickness of the segments from adapter to adapter may be accommodated without breaking the total containment of the tube T by the adapter.

It is also clear from FIG. 9A that when the segments $12^3$, $14^3$ are mated the interior surface of the interior recess $30^3$ of the adapter $10^3$ is interrupted by the inwardly projecting corners 50 on the mating surface $19^3$ of the segment $14^3$. The corners 50 lie inwardly of the corresponding corners 52 defined on the mating surface $12^3$. The radial distance $R_1$ measured between the central axis $10^3$A and the interior surface of the adapter segment $14^3$ in the region of the indentation $28^3$ therein is less than the radial distance $R_2$ measured between the central axis $10^3$A and the interior surface of the adapter segment $12^3$ in the region of the indentation $28^3$ therein. For reference purposes it is convenient at this point to define the radial distance $R_3$ as the distance between the central axis $10^3$ and the exterior surface of the adapter segment $14^3$ in the region of the indentation $28^3$ therein and the radial distance $R_2$ as the distance between the central axis $10^3$ and the exterior surface of the adapter segment $12^3$ in the region of the indentation $28^3$ therein. The thickness of the segment $12^3$ is equal to the difference between the distances $R_4$ and $R_2$, while thickness of the segment $14^3$ is equal to the difference between the distances $R_3$ and $R_1$.

To accommodate the instance where the rotor cavity $40^V$ is at its largest possible tolerance and the thickness of the segments of the adapter are at their smallest possible tolerance, the arc length of the inner surface of the segment $14^3$ (i.e., the distance between the points 50—50) in a plane perpendicular to the adapter axis $10^3$A (the plane of FIG. 9A) plus the arc length of the inner surface of the segment $12^3$ (i.e., the distance between the points 52—52) in the same plane must equal the circumference of the inside of the adapter in a plane perpendicular to the adapter axis $10^3$A in the case when the adapter of the smallest segment thickness is conformed to the largest rotor cavity, as illustrated in FIG. 9B.

The magnitude of angles of inclination of the surfaces may be measured by reference to a reference plane 54. The reference plane 54 is that plane that contains both the vertical central axis $10^3$ of the adapter $10^3$ and at least one of the inwardly projecting corners 50 of the adapter segment $14^3$. Alternatively, the reference plane 54 may be defined as the plane that is normal to the line of action 48 (superimposed on FIG. 9A) along which the segments $12^3$, $14^3$ are joined together. Measured with respect to the reference plane 54 the inclination of the surfaces $18^3$ and $19^3$ lies in the range of angles from about 10 to about 80 degrees. Preferably, each angle is forty five (45) degrees.

It should be noted that although the surfaces $18^3$ and $19^3$ are shown as being inclined to the same degree (i.e., the angles of the surfaces $18^3$ and $19^3$ with respect to the reference plane 54 are equal), such is not necessarily required. It is only necessary that the inclination of the surfaces $18^3$ and $19^3$ be such that the segments are maintained in mutual contact if they expand during centrifugation to fill the cavity $40^V$. It should also be noted that the segments $12^3$ and $14^3$ may be other than circular, and can be ellipsoidal, if desired.

An adapter in accordance with this embodiment of the present invention may be fabricated from any suitable material so long as the resulting adapter has sufficient strength (as that term is defined herein). The material of choice must exhibit other desirable properties, such as appropriate ultimate strength, appropriate modulus of elasticity, suitable chemical compatibility with any liquid sample being centrifuged and ability to withstand autoclaving. Suitable plastic materials include polypropylene, polyamide, acetal, polyphenylene oxide, polyvinyl choloride, polycarbonate or polyethylene. Other plastic or metallic materials (either homogeneous (neat) or fiber reinforced) with similar or better mechanical and chemical properties for the application under consideration may also be used. The adapter may be formed in any convenient manner consistent with the material selected, such as molding, machining, casting or forging.

In order to support a tube T in a vertical angle rotor without the assistance of the restraining force provided by a capping mechanism, the adapter $10^3$ must exhibit sufficient strength to absorb the forces imposed on the tube T by the pressure of the liquid therein. Thus, as the term is used herein, "sufficient strength" means that the adapter must be able to withstand the forces imposed on it during centrifugation without failing or deforming to the extent that the tube carried therein ruptures.

Whether a given adapter is of sufficient strength, and thus falls within the scope of the claims of the present invention, can be determined from various readily ascertainable operating parameters of the vertical angle rotor in which the adapter is to be used and the application to which the adapter is to be put. These parameters are the specific weight of the liquid sample within the tube received by adapter, the radius $R_i$ which represents the minimum distance to the sample from the axis A of rotation (FIG. 8), the diameter $D_o$ (FIG. 8) of the rotor cavity, the thickness of the adapter segment, the inside diameter of the tube, and the speed of rotation of the vertical angle rotor.

The pressure at any location across the diameter of the tube in which the liquid sample is disposed is $$P = \frac{\omega^2}{2g}\alpha(R_o^2 - R_i^2) \quad (1)$$

where

P is the pressure (psi), $\omega$ is the rotational velocity of the rotor (radians per second), g is acceleration due to gravity (inches per second$^2$), $\alpha$ is the specific weight of the sample (Lb per inch$^3$), $R_o$ is the distance to the point of interest x where the pressure value is desired from the center of rotation (inches), and $R_i$ is the minimum distance to the sample from the axis A of rotation (inches).

The total vertical force $F_V$ that the adapter must withstand is then found by integrating this pressure function over the circular cross sectional area of the inside of the tube.

Knowing the adapter dimensions and the force $F_V$, the average stress in the wall of the adapter can be determined in accordance with the relationship:

$$s = \frac{F_V}{(\pi/4)(D_o^2 - D_i^2)} \quad (2)$$

where s is the stress (psi), $F_V$ is the force (Lbf)

$D_o$ is the diameter of the rotor cavity, and $D_i$ is the inside diameter of the adapter when operating at speed, which equals the diameter of the rotor cavity minus the thickness of each of the segments of the adapter (FIG. 9B).

Based on the identity of the material used in the given adapter, the modulus of elasticity of that material may be readily obtained. An estimation of the vertical deformation of the adapter may be found by multiplying the initial length of the adapter by the average stress divided by the modulus of elasticity of the adapter material. If the average stress calculated in Equation (2) is less than the ultimate strength of the adapter material, and the predicted deformation is less than the deformation that will cause first leakage in the tube carried within the adapter, then the given adapter is to be construed to have sufficient strength for at least one operating cycle, and therefore falls within the contemplation of the present invention. The determination of sufficient strength as set forth above under operating conditions will verify both the analysis and the conclusion of the sufficiency of strength of the adapter.

It should be understood that it is within the contemplation of this invention to use an adapter in accordance herewith to support a tube or a predetermined portion thereof within a swinging bucket, thereby making the use of the adapter in accordance with this invention amenable for use in the environment of a swinging bucket rotor.

To recapitulate, the adapter heretofore described in connection with FIGS. 7A through 9B for use primarily in a vertical angle rotor is fabricated of a material and in a manner such that the adapter, while under centrifugation, has sufficient strength to withstand the vertical forces FV (that is, forces that act parallel to the central axis of the adapter). Vertical stresses in the tube T are therefore minimized. Angled mating edges on the adapter segments (FIGS. 7A and 9A) are provided to prevent a separation from forming between the segments in response to the radial expansion of the tube under pressure. The prevention of such a separation insures that the tube is supported about the entirety of its circumference such that the possibility of tube failure is minimized.

As yet another alternative embodiment of the present invention, the adapter may be designed and fabricated such that, under centrifugation, the body force of one adapter segment is sufficient to balance the force created by the pressure of a liquid carried in the tube under centrifugation that acts transversely to the central axis. As will be developed, when in use the preferred form of such an adapter must be disposed within a cavity of a rotor in an orientation such that the mating surfaces of the adapter segments lie in a plane that is substantially perpendicular to a radius of the rotor extending through the cavity. In such an orientation the line of action of closure of the preferred form of such an adapter aligns with a radial line extending from the axis of rotation of the rotor to the center of the cavity in which the adapter is disposed.

Figure 10:
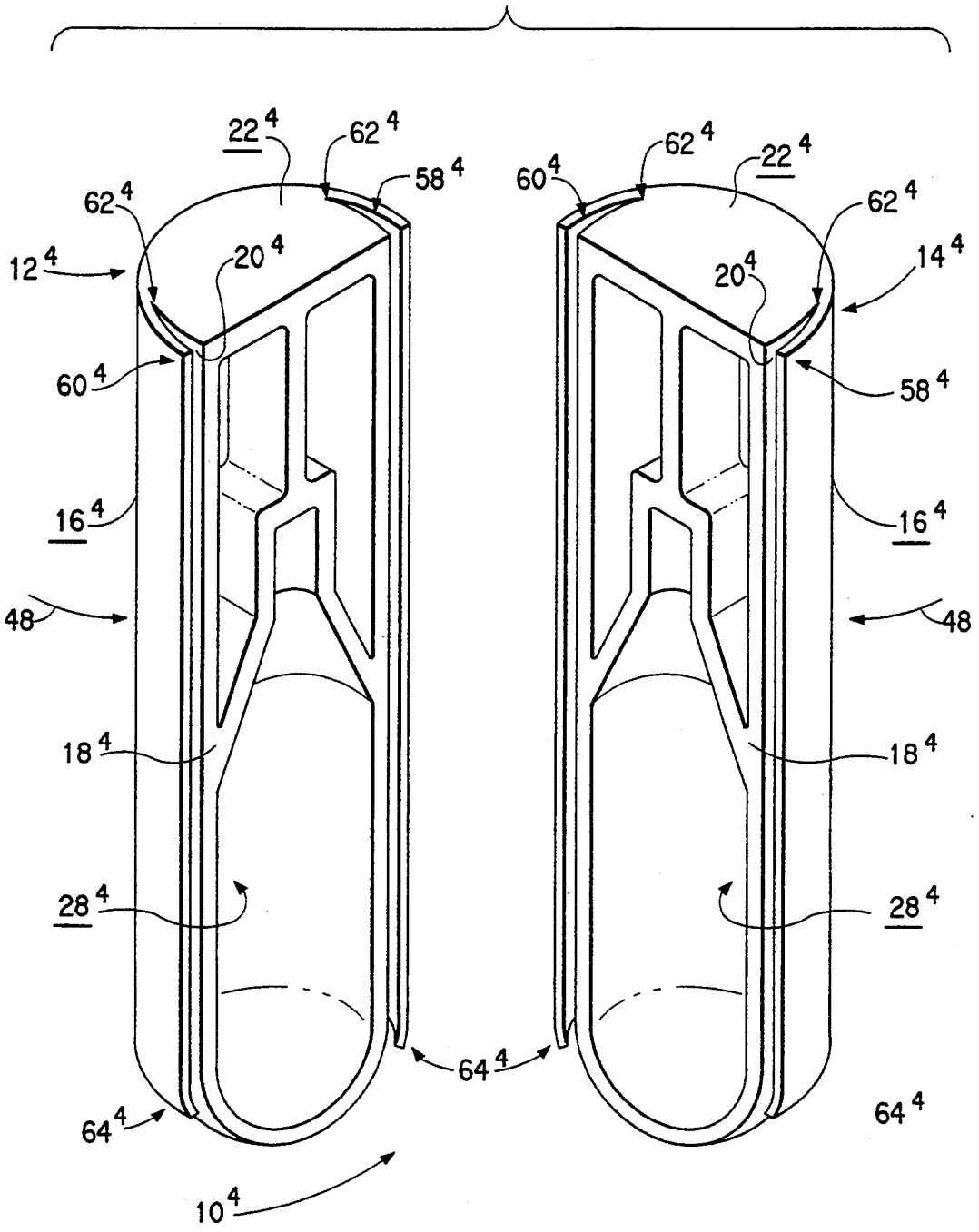
FIG. 10 is a perspective view of an adapter in accordance with yet another aspect of the present invention used to support a closed tube within the cavity of a vertical angle rotor.

FIG. 10 illustrates a preferred arrangement of a split adapter 10$^4$ for use in a vertical angle rotor in accordance with this embodiment of the present invention. The structure of the adapter 10$^4$ is generally similar to the adapter 10' shown and discussed in connection with FIGS. 3A and 3B and to the adapter 10$^3$ shown and discussed in connection with FIGS. 7A and 7B in the sense that the adapter 10$^4$, like the adapters 10' and 10$^3$, is arranged to totally surround a tube T disposed therewithin.

Figure 11A:
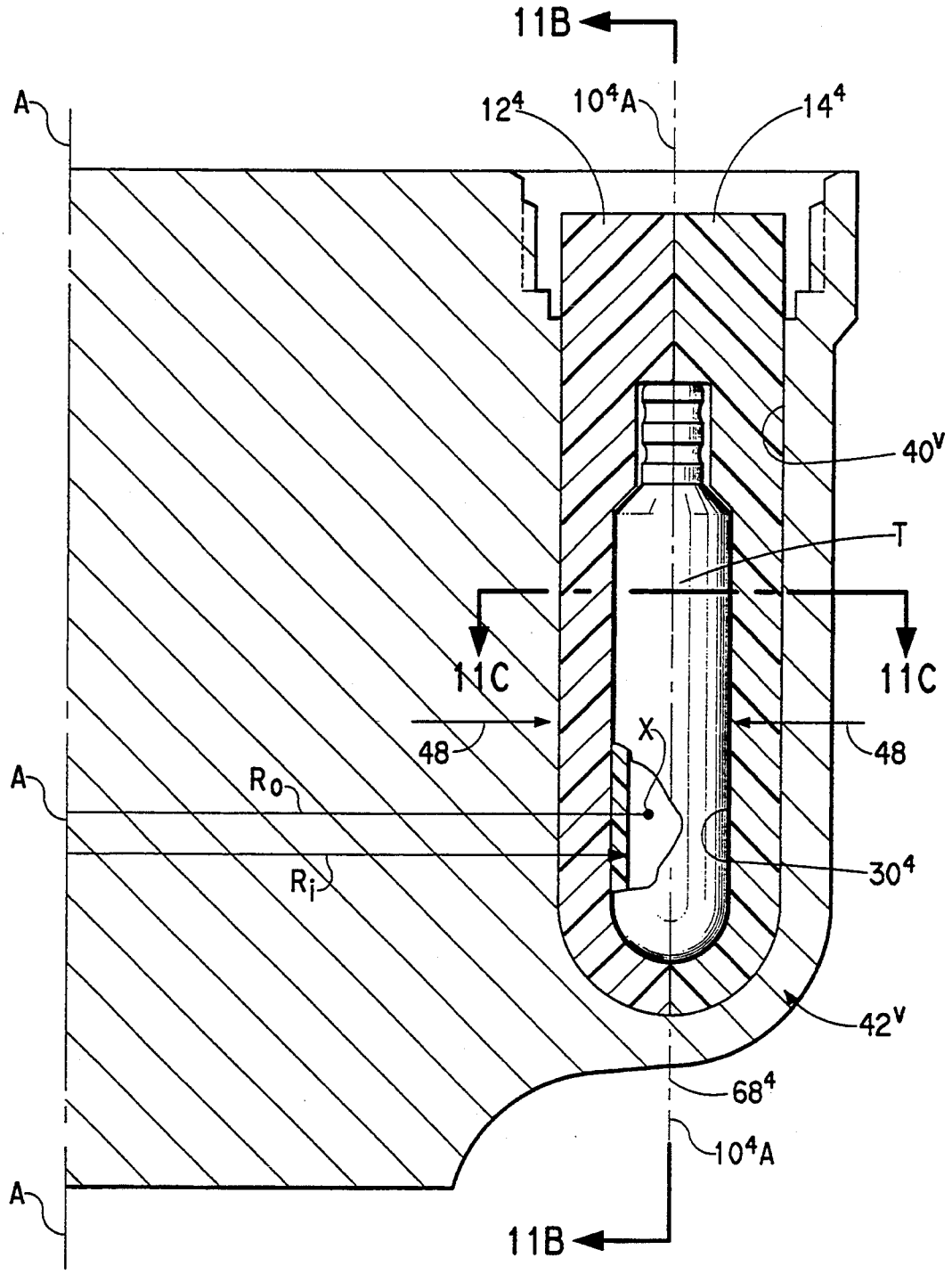
Figure 11B:
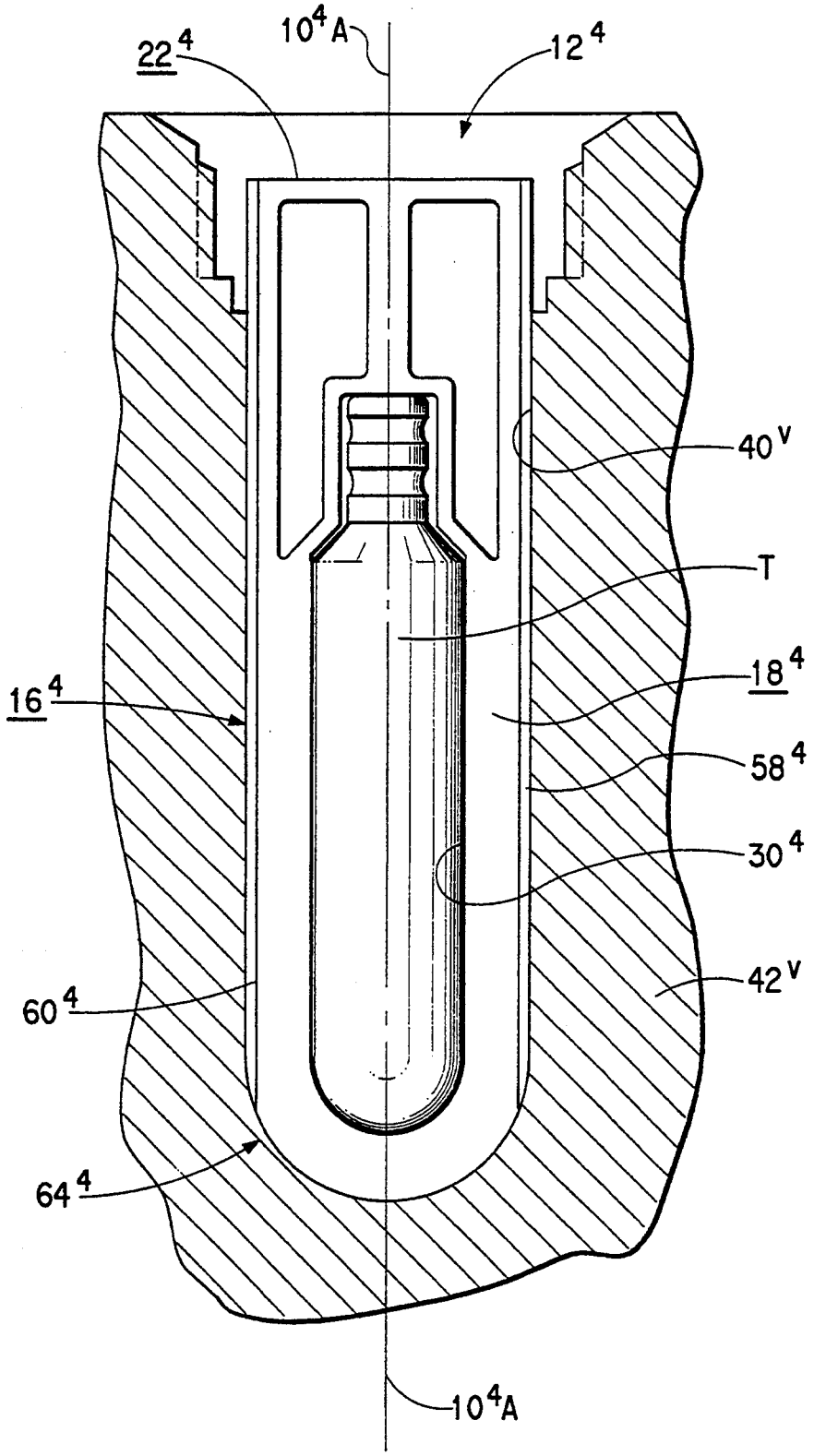
FIGS. 11B and 11C are, respectively, sectional views of the adapter as shown in FIG. 11A taken along section lines 11B—11B and 11C—11C.
Figure 11C:
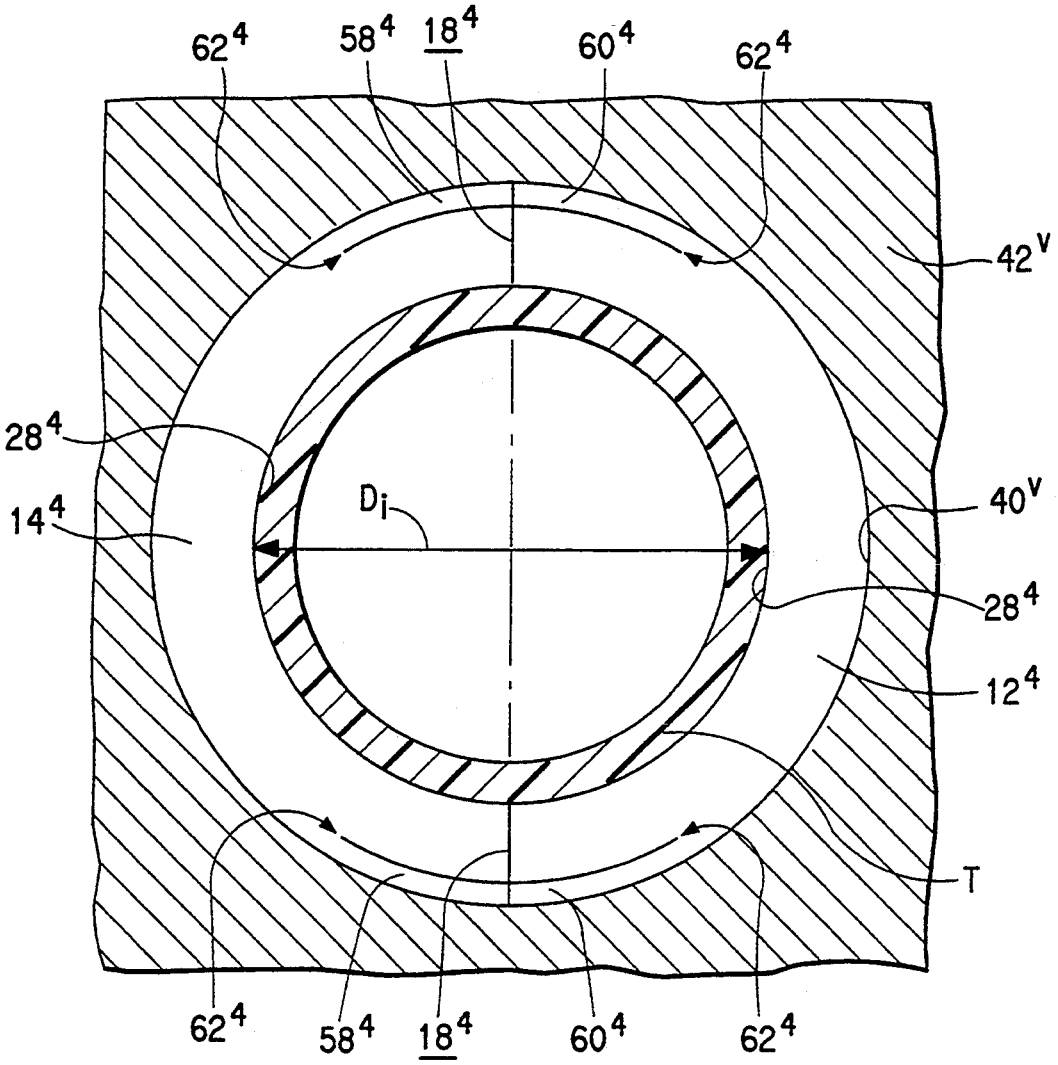

Structurally, the adapter 10$^4$ includes a first adapter segment 12$^4$ and a second adapter segment 14$^4$. Each segment 12$^4$, 14$^4$ has an exterior surface 16$^4$ and a mating surface 18$^4$ thereon. The exterior surface 16$^4$ of each segment 12$^4$, 14$^4$ is defined by a generally cylindrical lateral surface portion 20$^4$ and a planar upper surface portion 22$^4$. The exterior surface 16$^4$ of each segment 12$^4$, 14$^4$ is sized and shaped for close fitting receipt within the cavity 40$^V$ of a vertical angle rotor 42$^V$ (FIGS. 11A through 11C).

Each segment 12$^4$, 14$^4$ is provided with an indentation 28$^4$ in the mating surface 18$^4$ thereof. The indentation 28$^4$ in each segment 12$^4$, 14$^4$ is shaped so that when the segments 12$^4$ and 14$^4$ are joined along their mating surfaces 18$^4$ the indentations 28$^4$ cooperate to define a recess 30$^4$ able to totally surround a centrifuge tube T disposed therein. The adapter 10$^4$ has a central axis 10$^4$A extending therethrough (FIG. 11A). As will be discussed later, the recess 30$^4$ may be inclined with respect to the central axis 10$^4$A and remain within the contemplation of this invention.

The mating surfaces 18$^4$ of the segments 12$^4$, 14$^4$ need not be angled with respect to the reference plane as discussed previously in connection with FIGS. 9A, 9B, although they may be so arranged if desired. Alternatively or additionally, it should be noted that an adapter 10$^4$ in accordance with this embodiment of the present invention may be provided with a hinge on the upper surface 22$^4$ of the segments, similar to the embodiment shown in FIG. 7B. If a hinge is provided, the pivotal axis of the hinge extends perpendicular to the axis of the adapter. As discussed earlier, the hinge may take the form of a live hinge or a coined hinge.

In accordance with this embodiment of the invention, at least one of the segments of the adapter 10$^4$ must have a predetermined effective weight under centrifugation that is sufficient to prevent separation of the adapter segments. The effective weight of the adapter segment is defined as the weight of the segment at sea level multiplied by the g (gravity) force imposed on the segment when the same is rotated at a predetermined operating speed with the center of mass of the segment lying a predetermined radial distance from an axis of rotation.

At least one, but preferably, both of the segments $12^4$, $14^4$ has at least one, but preferably, a pair of resilient extensions $58^4$, $60^4$, respectively, thereon. In the preferred case the resilient extensions $58^4$, $60^4$ are flexibly mounted, as by hinging, to the outside surface $16^4$ of the segment along a line of bending $62^4$. The resilient extensions $58^4$, $60^4$ are biased to flare outwardly from the adapter segment, and are bendable along the line of bending $62^4$ to close inwardly toward the lateral surface portion $20^4$ of the outside surface $16^4$ of the segment to which they are attached. In the closed position the resilient extensions $58^4$, $60^4$ are in contact with the lateral surface portion $20^4$ of the outside surface $16^4$ of the segment to which they are attached. The lower end of each extension is tapered, as at $64^4$. It should be noted that when the adapter segments $12^4$, $14^4$ are mated the edges of resilient extensions $58^4$, $60^4$ are circumferentially spaced a slight distance apart, thereby to provide sufficient clearance to accommodate the flexing motion of the resilient extensions $58^4$, $60^4$ during insertion into the rotor cavity. As will become clearer herein each extension $58^4$, $60^4$ serves to frictionally interact with the boundaries of a rotor cavity $42^V$ (FIG. 11A through 11C) to prevent rotation of the adapter $10^4$ about its axis $10^4$A with respect to the body of the rotor $40^V$ thereby to maintain the adapter $10^4$ in a predetermined angular orientation within the cavity during operation of the rotor.

FIGS. 11A through 11C illustrate the adapter $10^4$ of FIG. 10 in use in a cavity $40^V$ of a vertical angle centrifuge rotor $42^V$. Sectioning of the adapter has been omitted from FIG. 11C for clarity of illustration. When disposed in the rotor $42^V$ the segment (for example, the segment $12^4$) which lies closer to the axis of rotation 10A of the rotor is termed the "inboard" segment. The other segment $14^4$ which lies farther from the axis of rotation 10A is termed the "outboard" segment. The inboard segment $12^4$ must have an effective weight sufficient to balance the force $F_T$ created by the pressure of a liquid carried in the tube under centrifugation that acts transversely to the central axis $10^4$A of the adapter $10^4$. Such an arrangement precludes separation of the adapter segments $12^4$, $14^4$ during centrifugation. When properly positioned in the cavity $40^V$ of the rotor $42^V$ the mating surfaces $18^4$ of the adapter segments $12^4$, $14^4$ are disposed so as to lie in a plane 68 (FIG. 11A) that is substantially perpendicular to a radius of the rotor $42^V$ extending through the cavity $40^V$. The plane 68 is the plane of FIG. 11B.

It should be noted that in some instances the recess $30^4$ may be arranged within the adapter $10^4$ such that an axis extending centrally through the recess $30^4$ of the adapter $10^4$ is offset radially with respect to the axis $10^4$A of the adapter $10^4$. In such an arrangement the recess $30^4$ is not concentric with the generally cylindrical lateral surface portion $20^4$ of the adapter $10^4$. If so offset it its preferred that the recess $30^4$ be displaced radially outwardly with respect to the axis $10^4$A of the adapter $10^4$. Such an arrangement may be utilized to increase the effective weight of the inboard segment $12^4$ and/or to dispose the sample to higher g-forces resulting from the increased radial distance to the sample.

Whether the inboard adapter segment $12^4$ has an effective weight sufficient for the purpose of containing the transverse force $F_T$, and thus fall within the scope of the claims of the present invention, can be determined from consideration of the identical operating parameters as previously developed and described in connection with the "sufficient strength" determination for accommodation of the vertical force $F_V$.

As earlier noted the pressure P across the diameter of the tube is defined by Equation (1). The value of the pressure P ranges from zero at the inboard edge of the tube to a maximum value at the farthest radial location of the liquid sample from the axis of rotation of the rotor. The inboard segment $12^4$ of the adapter $10^4$ is subjected to a radially inwardly directed force $F_T$ that results from liquid pressure in the inboard half of the tube. The magnitude of this radially inwardly directed force FT is determined by integrating the component of the pressure function defined by Equation (1) that is parallel to a radial line through the center of mass of the inboard segment $12^4$ over the surface area of the indentation $28^4$ of the adapter segment $12^4$. So long as the effective weight of the inboard segment $12^4$ is equal to or greater than the force $F_T$ due to liquid pressure, then centrifugal force effects acting on the inboard segment $12^4$ cause the mating surfaces $18^4$ of the adapter segments $12^4$, $14^4$ to remain in contacting relationship. The adapter $10^4$ will thus maintain complete containment of the tube during operation of the rotor.

An adapter $10^4$ having segments $12^4$, $14^4$ in accordance with this embodiment of the invention may be fabricated from any suitable material so long as the resulting adapter segment $12^4$ has sufficient effective weight (as that term is defined herein) and exhibits suitable chemical compatibility with any liquid sample being centrifuged and the ability to withstand autoclaving. Suitable plastic materials include polypropylene, polyamide, acetal, polyphenylene oxide, polyvinyl choloride, polycarbonate or polyethylene. Other plastic or metallic materials (either homogeneous (neat) or fiber reinforced) with similar or better mechanical and chemical properties for the application under consideration may also be used. The adapter may be formed in any convenient manner consistent with the material selected., such as molding, machining, casting or forging.

It should be understood that both the segments $12^4$, $14^4$ may be substantially identical in weight or they may be substantially different in weight, so long as the inboard adapter segment has the requisite effective weight to completely contain the tube T during operation of the rotor.

Although not required of this embodiment, it is preferred that the adapter $10^4$ also be fabricated of a material that has sufficient strength to withstand the vertical force $F_V$ due to liquid pressure under centrifugation, as discussed in connection with FIGS. 7A through 9B. Of course, if the adapter $10^4$ is not able to withstand the vertical force $F_V$, then a separate capping arrangement on the rotor is required.

By providing the inboard segment $12^4$ having a suitable effective weight the mating surfaces on the inboard and outboard segments remain in contact during operation of the rotor and no gap therebetween may form. The tube T is thus completely contained within the conjoined adapter segments during operation of the rotor, and the possibility of tube failure due to extrusion into a gap is precluded. The present embodiment carries the additional benefit of minimizing circumferential stress in the tube caused by the pressure of the liquid, therefore further reducing the possibility of tube failure. Since the effective weight of the inboard segment of the adapter is at least as great as the transverse force due to pressure $F_T$, the inboard segment limits expansion of tube. Greater tube reliability over a greater range of tube, adapter and cavity tolerances is thus produced.

As previously mentioned, the adapter 10$^4$ must be disposed in the cavity 40$^V$ of the rotor 42$^V$ in an orientation which substantially aligns the line of action 48 of closure of the adapter segments 12$^4$, 14$^4$ with a radial line extending from the axis of rotation of the rotor to the center of the cavity 40$^V$ in which the adapter is disposed and which places the mating surfaces 18$^4$ of the adapter segments 12$^4$, 14$^4$ in the plane 68 (FIG. 11A) that is perpendicular to the radius extending through the cavity 40$^V$. To meet this need, the segments 12$^4$, 14$^4$ may be keyed in a fashion to be described.

If both segments 12$^4$, 14$^4$ have the requisite effective weight sufficient to ensure complete containment of the tube in the adapter recess, then either segment may assume the position of the inboard segment. Thus, the adapter may be inserted into the cavity in either of two different orientations and the desired performance will occur.

The keying can be implemented by providing any suitable distinctive physical feature on the adapter, such as a visually distinctive marking or a distinctive shape.

Should only one segment 12$^4$ exhibit the requisite effective weight then a form of keying is necessary which both: (1) identifies that segment as the inboard segment; and (2) aligns the mating surfaces 18$^4$ of the adapter segments 12$^4$, 14$^4$ in the plane 68.

Figure 12A:
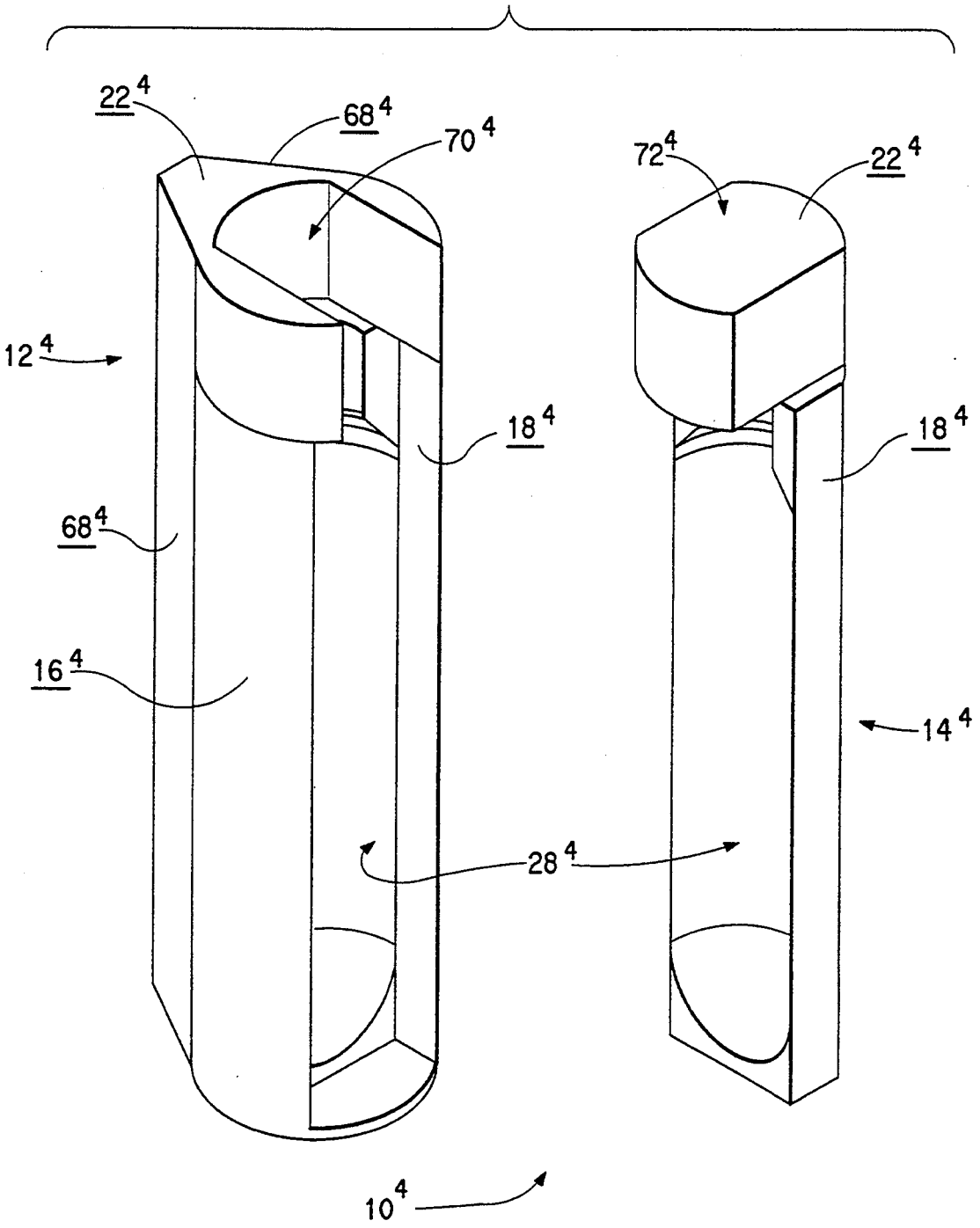
Figure 12B:
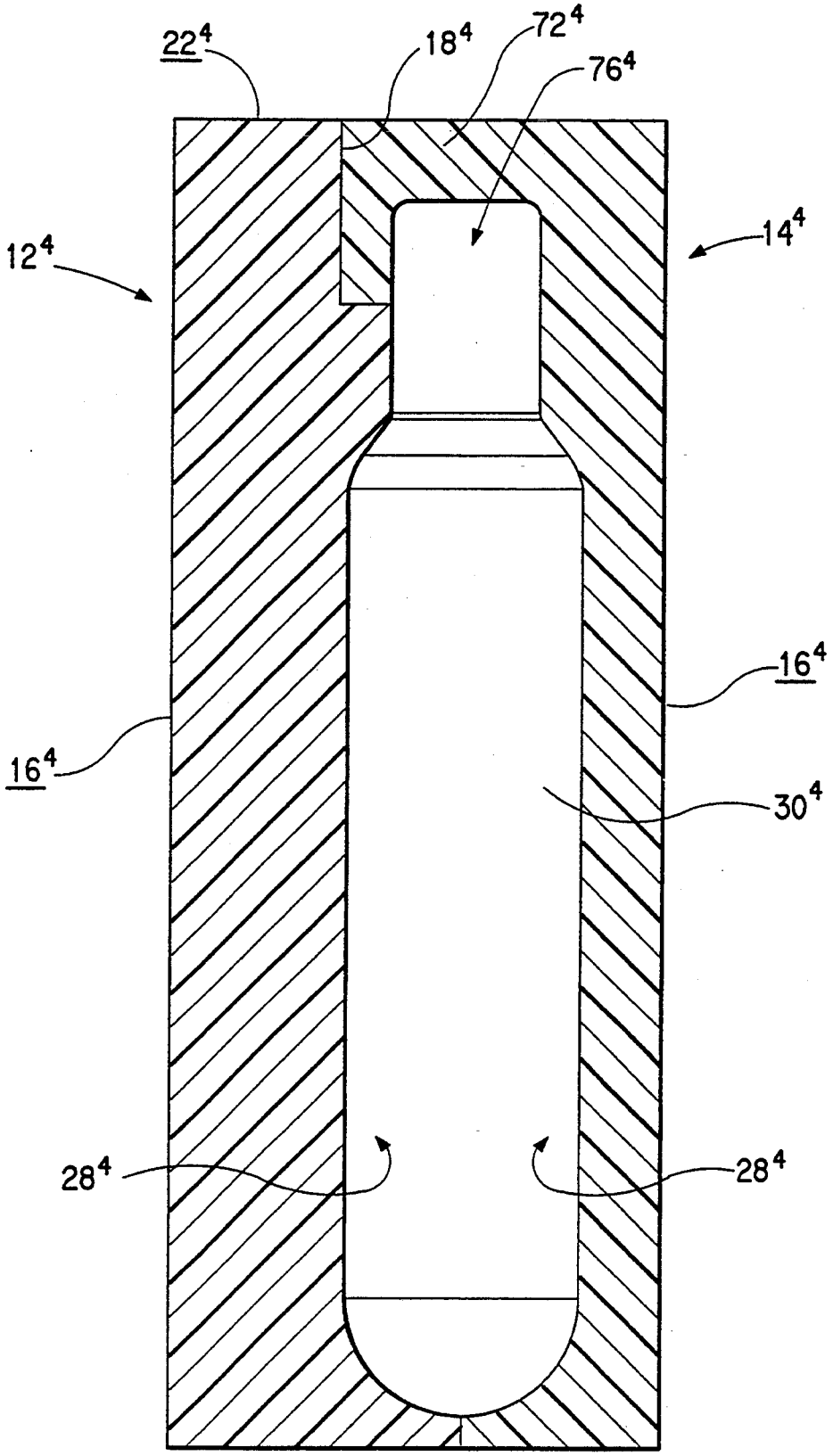
FIG. 12B is a side sectional view of the adapter of FIG. 12A with the adapter segments joined together.

A particular modified configuration of an adapter 10$^4$ in which only one segment 12$^4$ exhibits the requisite effective weight is illustrated in FIGS. 12A and 12B. In this modification the inboard adapter segment 12$^4$ has a distinctive configuration imparted thereto in the form of the flat surfaces 68$^4$ provided on the exterior surface 16$^4$ of the segment 12$^4$. The cavity 40$^V$ into which the adapter 10$^4$ of FIG. 12 is insertable is correspondingly shaped, thus to ensures that the adapter 10$^4$ is properly received into the rotor 42$^V$.

In addition, a portion of the upper surface 22$^4$ of the inboard segment 12$^4$ is removed to define a channel 70$^4$ therein. The mating surfaces 18$^4$ on the inboard segment 12$^4$ are flush with the boundaries of the channel 70$^4$. The upper surface 22$^4$ of the outboard segment 14$^4$ is provided with a projecting flange 72$^4$ that is shaped in correspondence to the channel 70$^4$. In addition, the mating surfaces 18$^4$ on the outboard segment 14$^4$ are arranged to slidably engage the corresponding mating surfaces 18$^4$ on the inboard segment 12$^4$. The undersurface of the flange 72$^4$ has a pocket 76$^4$ therein that accepts the upper capped end of the tube T.

This structure defines a compact, cartridge-like adapter 10$^4$ for the tube T. When the segments are separated, the tube T is retained in the outboard segment 14$^4$ with the capped end of the tube T received in the pocket 76$^4$ therein. This disposition is believed to facilitate handling of the tube T.

As briefly noted earlier, it may be desirable in some instances to orient the indentations within each adapter segment such that a central axis through the recess formed when the segments are joined is inclined to the axis of the adapter. Such an adapter may be useful in converting a vertical angle rotor to a rotor having a "near vertical" cavity orientation. The mating surfaces of the segments in such a case will lie in a plane that contains the axis of the recess, said plane also being inclined with respect to the axis of the adapter. These mating surfaces of such an adapter need not, therefore, align with the plane perpendicular to a radius extending from the axis of rotation of the rotor through the center of the cavity, as is the case in connection with the preferred embodiment of this aspect of the invention as shown in FIGS. 10 through 12. It should be understood, however, that so long as the effective weight of the inboard segment while under centrifugation is sufficient to maintain the mating surfaces of the adapter segments in contacting relationship with each other, such a modified "near vertical" adapter lies within the contemplation of the present invention as defined by the appended claims.

Those skilled in the art, having the benefit of the teachings of the present invention may impart numerous modifications thereto. It should be understood that such modifications are also to be construed to lie within the scope of the present invention, as defined by the appended claims.

What is claimed is:

1. An adapter for supporting a centrifuge tube within a cavity in a centrifuge rotor, the tube having a predetermined size and configuration, the adapter having an axis extending therethrough that, in use, aligns in parallel relationship with an axis of the rotor cavity in which the adapter is disposed, the adapter comprising:

a first and a second adapter segment, each segment having an exterior surface and a mating surface thereon, each segment having an indentation in the mating surface thereof, at least one hinge connecting the segments and supporting the relative pivotal movement, about a hinge axis, of at least one segment with respect to the other from an open to a mated position, the hinge axis-extending perpendicular to the axis of the adapter, in the mated position, the mating surfaces of the segments being disposed in contacting relationship and the indentations therein cooperating to define a recess having a size and shape that corresponds to the size and shape of at least a portion of the tube.

2. The adapter of claim 1 wherein the centrifuge tube has a body with a neck thereon, a portion of the neck having a constricted region thereon when the tube is capped, the indentation in each segment being shaped such that when the segments are in the mated position the indentations cooperate to define a recess that corresponds to the size and shape of the neck of the tube, at least one of the segments having a feature on the mating surface thereof that projects into the indentation therein such that, when the segments are in the mated position and the tube is received within the adapter, the feature is received within the constricted region in the neck of the tube.

3. The adapter of claim 2 further comprising an enlarged collar disposed on the exterior surface of at least one of the segments.

4. The adapter of claim 1 wherein the centrifuge tube has a body with a predetermined configuration over its entire length, the indentation in each segment being shaped such that when the segments are in the mated position the indentations cooperate to define a recess that corresponds to the size and shape of the centrifuge tube over its entire length.

5. The adapter of claim 4 further comprising an enlarged collar disposed on the exterior surface of at least one of the segments.

6. The adaptor of claim 4 wherein the mating surface on the first adapter segment defines a first predetermined angle with respect to a predetermined plane while the mating surface on the second adapter segment defines a second predetermined angle with respect to the predetermined reference plane, the reference plane being defined as the plane that contains the axis of the adapter and that lies normal to the line of action along which the segments of the adapter are mated.

7. The adapter of claim 1 further comprising an enlarged collar disposed on the exterior surface of at least one of the segments.

8. An adapter for supporting a closed centrifuge tube within a cavity of a vertical angle centrifuge rotor, the tube having a body portion that tapers through a transition region to a narrowed neck region, the adapter having an axis extending therethrough, the adapter comprising a first and a second adapter segment, each segment having an exterior surface and a mating surface thereon, the mating surfaces of the adapter extending generally axially along each adapter segment, each segment having an indentation in the mating surface thereof, the indentation in each segment being shaped such that when the segments are joined along their mating surfaces the indentations cooperate to define a recess that corresponds to the size and shape of the entire axial length of a centrifuge tube able to be disposed therein, the mating surfaces being in contacting relationship with each other over at least the neck and transition regions of the tube, the adapter being fabricated of a material that has sufficient strength to withstand the vertical forces created by the pressure of a liquid carried in the tube under centrifugation that act .against the neck and transition regions of the tube.

9. The adaptor of claim 8 wherein the mating surface on the first adapter segment defines a first predetermined angle with respect to a predetermined plane while the mating surface on the second adapter segment defines a second predetermined angle with respect to the predetermined reference plane, the reference plane being defined as the plane that contains the axis of the adapter and that lies normal to the line of action along which the segments of the adapter are mated.

10. The adaptor of claim 9 wherein the first predetermined angle and the second predetermined angle are equal.

11. The adaptor of claim 9 wherein the first predetermined angle lies within the range from about ten (10) to about eighty (80) degrees.

12. The adaptor of claim 11 wherein the second predetermined angle lies within the range from about ten (10) to about eighty (80) degrees.

13. The adaptor of claim 8 further comprising at least one hinge connecting the segments and supporting the relative pivotal movement, about a hinge axis, of at least one segment with respect to the other from an open to a mated position, the hinge axis extending perpendicular to the axis of the adapter.

14. An adapter for supporting a centrifuge tube having a predetermined size and configuration within a cavity in a centrifuge rotor, the adapter having an axis extending therethrough that, in use, aligns in parallel relationship with an axis of the rotor cavity in which the adapter is disposed, the adapter comprising:

a first and a second adapter segment, each segment having an exterior surface and a mating surface thereon, each segment having an indentation in the mating surface thereof, the indentation in each segment being shaped such that when the segments are joined along their mating surfaces the indentations cooperate to define a recess able to totally surround a centrifuge tube disposed therein, the mating surface on the first adapter segment having a pair of edges thereon that projects into the recess in the adapter.

15. The adapter of claim 14 wherein the mating surface on the first adapter segment defines a first predetermined angle with respect to a predetermined reference plane while the mating surface on the second adapter segment defines a second predetermined angle with respect to the predetermined reference plane, the reference plane being defined as the plane that contains the axis of the adapter and that lies normal to the line of action along which the segments of the adapter are mated.

16. The adapter of claim 15 wherein the centrifuge rotor is a vertical angle rotor, and wherein the adapter segments are fabricated of a material that has sufficient strength to withstand the vertical forces created by the pressure of a liquid under centrifugation.

17. The adapter of claim 16 further comprising at least one hinge connecting the segments and supporting the relative pivotal movement, about a hinge axis, of at least one segment with respect to the other from an open to a mated position, the hinge axis extending perpendicular to the axis of the adapter.

18. The adapter of claim 15 further comprising at least one hinge connecting the segments and supporting the relative pivotal movement, about a hinge axis, of at least one segment with respect to the other from an open to a mated position, the hinge axis extending perpendicular to the axis of the adapter.

19. The adapter of claim 14 wherein the centrifuge rotor is a vertical angle rotor, and wherein the adapter segments are fabricated of a material that has sufficient strength to withstand the vertical forces created by the pressure of a liquid under centrifugation.

20. The adapter of claim 19 further comprising at least one hinge connecting the segments and supporting the relative pivotal movement, about a hinge axis, of at least one segment with respect to the other from an open to a mated position, the hinge axis extending perpendicular to the axis of the adapter.

21. The adapter of claim 14 further comprising at least one hinge connecting the segments and supporting the relative pivotal movement, about a hinge axis, of at least one segment with respect to the other from an open to a mated position, the hinge axis extending perpendicular to the axis of the adapter.

22. An adapter for supporting a closed centrifuge tube within a cavity in a vertical angle centrifuge rotor, the adapter comprising:

a first, inboard, adapter segment and a second, outboard, adapter segment, each segment having an exterior surface and a mating surface thereon, each segment having an indentation in the mating surface thereof, the indentation in each segment being shaped such that when the segments are joined along their mating surfaces the indentations cooperate to define a recess able to totally surround a centrifuge tube disposed therein, the adapter having a central axis extending therethrough, at least the first, inboard, segment of the adapter having an effective weight sufficient to balance forces created by the pressure of a liquid carried in the tube under centrifugation that act transversely to the central axis, so that, in use with the adapter inserted into a cavity of a rotor with the mating surfaces of the adapter segments being in contacting relationship with each other, the effective weight of the inboard segment while under centrifugation is sufficient to maintain the mating surfaces of the adapter segments in such contacting relationship.

23. The adapter of claim 22 wherein the outboard segment has a predetermined effective weight, and wherein the effective weight of the inboard segment is different from the effective weight of the outboard segment.

24. The adapter of claim 23 wherein the effective weight of the inboard segment is greater than the effective weight of the outboard segment.

25. The adapter of claim 23 wherein one of the segments has a distinctive feature thereon.

26. The adapter of claim 25 wherein the distinctive feature is a visual feature.

27. The adapter of claim 25 wherein the inboard segment has a predetermined shape, and wherein the distinctive feature is the shape of the inboard segment.

28. The adapter of claim 25 wherein the distinctive feature is on the inboard segment.

29. The adapter of claim 28 wherein the distinctive feature is a visual marking.

30. The adapter of claim 28 wherein the inboard segment has a predetermined shape, and wherein the distinctive feature is the shape of the inboard segment.

31. The adapter of claim 22 wherein the outboard segment has a predetermined effective weight, and wherein the effective weight of the inboard segment is the same as the effective weight of the outboard segment.

32. The adapter of claim 22 wherein one of the segments has a distinctive feature thereon.

33. The adapter of claim 32 wherein the distinctive feature is a visual marking.

34. The adapter of claim 32 wherein the inboard segment has a predetermined shape, and wherein the distinctive feature is the shape of the inboard segment.

35. The adapter of claim 32 wherein the distinctive feature is on the inboard segment.

36. The adapter of claim 35 wherein the distinctive feature is a visual feature.

37. The adapter of claim 35 wherein the inboard segment has a predetermined shape, and wherein the distinctive feature is the shape of the inboard segment.

38. The adapter of claim 22 wherein each of the segments has an exterior surface thereon, at least one of the segments has at least a first resilient extension thereon, the resilient extension being biased to flare outwardly from the adapter segment, the resilient extension being bendable with respect to the adapter segment from the flared position to a second position in which the extension contacts against the exterior surface of the segment on which it is disposed, when the adapter is disposed in a rotor, the extension frictionally interacts with the boundaries of a rotor cavity to prevent rotation of the adapter about its axis with respect to the body of the rotor, thereby to maintain the adapter in a predetermined angular orientation within the cavity during operation of the rotor.

39. The adapter of claim 38 wherein the extension is hinged to the segment along a line of bending disposed on the exterior surface of the segment on which it is disposed.

40. The adapter of claim 39 wherein the extension has a tapered portion thereon.

41. The adapter of claim 22 wherein inboard segment has an exterior surface thereon, the exterior surface having at least one planar keying region defined thereon.

42. The adapter of claim 41 wherein both the inboard segment and the outboard segment have an upper surface thereon, the inboard segment having a channel formed through the upper surface thereon, the outboard segment having a flanged shaped in correspondence to the channel disposed on the upper surface thereof, the flange having a pocket formed therein, the pocket being sized to receive the end of a tube received within the adapter.

43. The adapter of claim 22 wherein the centrifuge rotor is a vertical angle rotor, and wherein the adapter segments are fabricated of a material that has sufficient strength to withstand the vertical forces created by the pressure of a liquid under centrifugation.

44. The adapter of claim 22 further comprising at least one hinge connecting the segment's and supporting the relative pivotal movement, about a hinge axis, of at least one segment with respect to the other from an open to a mated position, the hinge axis extending perpendicular to the axis of the adapter.

* * * * *